US011534368B2

(12) United States Patent
Park et al.

(10) Patent No.: US 11,534,368 B2
(45) **Date of Patent: *Dec. 27, 2022**

(54) MASSAGE CHAIR CAPABLE OF PERFORMING ACUPUNCTURE POINT MASSAGE

(71) Applicant: COWAY CO., LTD., Gongju-si (KR)

(72) Inventors: Kyung Hwan Park, Seoul (KR); Yeon Soo Seong, Seoul (KR); Byoung Chan Bae, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 349 days.

This patent is subject to a terminal disclaimer.

(21) Appl. No.: 16/636,383

(22) PCT Filed: Jul. 6, 2018

(86) PCT No.: PCT/KR2018/007696
§ 371 (c)(1),
(2) Date: Feb. 4, 2020

(87) PCT Pub. No.: WO2019/035556
PCT Pub. Date: Feb. 21, 2019

(65) Prior Publication Data

US 2020/0170882 A1 Jun. 4, 2020

(30) Foreign Application Priority Data

Aug. 17, 2017 (KR) ..... 10-2017-0104208

(51) Int. Cl.
*A61H 39/04* (2006.01)
*A61H 9/00* (2006.01)
*A61H 15/00* (2006.01)

(52) U.S. Cl.
CPC ..... *A61H 39/04* (2013.01); *A61H 9/0078* (2013.01); *A61H 15/00* (2013.01);
(Continued)

(58) Field of Classification Search
CPC .... A61H 15/00; A61H 15/02; A61H 15/0078; A61H 39/04; A61H 2201/5064;
(Continued)

(56) References Cited

U.S. PATENT DOCUMENTS 6,117,094 A * 9/2000 Fujii ..... A61H 39/04 601/102
2002/0082534 A1* 6/2002 Jikiba ..... A61H 15/0078 601/99

(Continued)

FOREIGN PATENT DOCUMENTS

CN 103284733 A 9/2013
EP 1062934 A1 12/2000

(Continued)

OTHER PUBLICATIONS

Chinese Office Action dated Jul. 28, 2021 for Chinese Application No. 201880053402.4; 11 Pages.

(Continued)

*Primary Examiner* — Colin W Stuart
*Assistant Examiner* — Douglas Y Sul
(74) *Attorney, Agent, or Firm* — Daly Crowley Mofford & Durkee, LLP

(57) ABSTRACT

Disclosed is a massage chair capable of performing acupuncture point massage. More particularly, disclosed is a massage chair comprising: a seat 200; a back support portion 100 rotatably mounted on one side of the seat 200; a calf massage portion 400 rotatably mounted on the other side of the seat 200; and a manipulation portion 600 capable of adjusting movements of the back support portion 100 and the calf massage portion 400, in which the manipulation portion 600 includes: a shoulder height measurement module 610 for measuring the shoulder height of the user; a hip bone location prediction module 620 for predicting the hip (Continued)

bone location by using a preset first method with reference to the shoulder height measured by the shoulder height measurement module 610; a massage location determination module 630 for determining a plurality of massage locations based on the hip bone location predicted by the hip bone location prediction module 620; and a massage mode selection module 640 for selecting one massage mode of a plurality of previously-stored massage modes based on the plurality of massage locations determined by the massage location determination module 630, thereby massaging the plurality of massage locations determined by the massage location determination module 630 in accordance with the massage mode selected by the massage mode selection module 640.

13 Claims, 17 Drawing Sheets

(52) U.S. Cl.
CPC ..... *A61H 2015/0042* (2013.01); *A61H 2201/0149* (2013.01); *A61H 2201/5023* (2013.01); *A61H 2201/5064* (2013.01); *A61H 2205/081* (2013.01); *A61H 2205/088* (2013.01); *A61H 2205/10* (2013.01); *A61H 2205/12* (2013.01); *A61H 2230/855* (2013.01)

(58) Field of Classification Search
CPC .... A61H 2201/5023; A61H 2201/0149; A61H 2201/0142; A61H 2201/0146; A61H 2201/50; A61H 2201/1669; A61H 2205/081; A61H 2230/82; A61H 2230/825; A61H 2230/85; A61H 2230/855
See application file for complete search history.

(56) References Cited

U.S. PATENT DOCUMENTS

| | | | | |
|---|---|---|---|---|
| 2007/0225624 | A1* | 9/2007 | Tsukada | A61H 15/0078 601/49 |
| 2009/0005715 | A1* | 1/2009 | Taniguchi | A61H 23/02 601/99 |
| 2014/0371638 | A1* | 12/2014 | Lee | A61H 15/0078 601/18 |
| 2017/0258673 | A1* | 9/2017 | Inada | A61H 9/0078 |
| 2020/0197255 | A1* | 6/2020 | Bae | A47C 31/126 |

FOREIGN PATENT DOCUMENTS

| | | | |
|---|---|---|---|
| EP | 1629817 | A1 | 3/2006 |
| JP | 2006-087737 | A | 4/2006 |
| KR | 10-0726805 | B1 | 6/2007 |
| KR | 10-2011-0112922 | A | 10/2011 |
| KR | 10-1345830 | B1 | 12/2013 |
| KR | 10-1402337 | B1 | 6/2014 |
| KR | 10-2016-0097942 | A | 8/2016 |
| KR | 10-2016-0119995 | A | 10/2016 |

OTHER PUBLICATIONS

International Search Report and Written Opinion (with English Translation) dated Jan. 3, 2019 for International Application No. PCT/KR2018/007696; 4 Pages.

* cited by examiner

FIG. 4

| Location | Acupuncture points | Massage ball assembly |
|---|---|---|
| C1-2 | An myeon | Upper massage ball (720) |
| C1-2 | Pung bu | |
| C2 | Cheon ju | |
| C2 | Pung ji | |
| C7 | Gyeon jeong | |
| C7 | Gyeon jung su | |
| T1 | Gyeon oe su | Lower massage ball (730) |
| T2 | Ji su | |
| T6-6 | Sim su | |
| T6-7 | Yeong dae | |
| T7-8 | Dok su | |
| T7-8 | Ui hoe | |
| T8-9 | Gyeok su | |
| T8-9 | Gyeok gwan | |
| T8-9 | Ji yang | |
| T9-10 | Hon mun | |
| T9-10 | Gan su | |
| T10-11 | Dam su | |
| T10-11 | Yang gang | |
| T11-12 | Bi su | |
| T11-12 | Ui sa | |
| T12-L1 | Wi su | |
| T12-L1 | Wi chang | |
| L1-L2 | Sam cho su | |
| L2-L3 | Sin su | |
| L2-L3 | Ji sil | |
| L2-L3 | Myeong mun | |
| L3-L4 | Gi hae su | |
| L4-L6 | Dae jang su | |
| Between B4 and sacrum bone | Gwan won su | |
| Sacrum bone | So jang su | |
| Sacrum bone | Bang gwang su | |
| Sacrum bone | Sang nyo | |
| Coccyx | Mi gol dan | |
| Coccyx | Cha ryo | |

FIG. 5

| Location | Acupuncture Points |
|---|---|
| Lines of Acupuncture Points | Line 1 of bang gwang su |
| | Line 2 of bang gwang su |
| Arm/Hand | No gung |
| | So bu |
| | Nae gwan |
| | Hap gok |
| | Gong choe |
| | Hu gye |
| | Jung jeo |
| | Oe gwan |
| | Yeol gyeol |
| | Tae yeon |
| | Sin mun |
| | So sang |
| | Su sam ni |
| Thigh | Eum gok |
| Calf | Yang neung cheon |
| | Jok sam ni |
| | Pung nyung |
| | Eum neung cheon |
| | Chuk bin |
| | Bu lyu |
| | Seung san |
| | Seung geun |
| Foot | Jung do |
| | Dae do |
| | Gol lyun |
| | Hyeon jong |
| | Sam eum gyo |
| | Tae gye |
| | Bu lyu |
| | Su cheon |
| | Tae chung |
| | Yong cheon |
| | Sil myeon |
| | Sole |

FIG. 6

| Location of airbag | | Major Acupuncture Points |
|---|---|---|
| Arm - Upper/Left | Arm - Upper/Right | Gong choe, Su sam ni |
| Arm - Middle/Left | Arm - Middle/Right | So sang, Hap gok, Hu gye, Jung jeo, So bu, Nae gwan, Oe gwan, Yeol gyeol, No gung, Sin mun, Tae yeon |
| Left - Lower/Left | Left - Lower/Right | So sang, Hap gok, Hu gye, Jung jeo, So bu, No gung, Sin mun, Tae yeon |
| Thigh | | Eum gok |
| Calf - Outer/Upper (Left/Right Common) | | Yang neung cheon, Jok sam ni |
| Calf - Outer/Lower (Left/Right Common) | | Pung nyung |
| Calf - Inner/Upper (Left/Right Common) | | Eum neung cheon, Jung do |
| Calf - Inner/Lower (Left/Right Common) | | Chuk bin, Jung do, Bu lyu |
| Calf - Rear/Upper end, Lower end | | Seung san |
| Calf - Rear/Middle | | Seung geun |
| Foot - Front | | Jung do, Dae do |
| Foot - Back | | Gol lyun, Hyeon jong, Sam eum gyo, Tae gye, Bu lyu, Su cheon |
| Foot - Top | | Tae chung |
| Sole | | Yong cheon, Sil myeon |

MASSAGE CHAIR CAPABLE OF PERFORMING ACUPUNCTURE POINT MASSAGE

CROSS REFERENCE TO RELATED APPLICATIONS

This present application is a national stage filing under 35 U.S.C. § 371 of International Patent Application No. PCT/KR2018/007696 filed on Jul. 6, 2018 which is based upon and claims the benefit of priority to Korean Patent Application No. 10-2017-0104208 filed on Aug. 17, 2017 in the Korean Intellectual Property Office. The disclosures of the above-listed applications are hereby incorporated by reference herein in their entireties.

TECHNICAL FIELD

The present invention relates to a massage chair, and more particularly, to a massage chair capable of performing acupuncture point massage.

BACKGROUND ART

Numerous people choose massages to relieve stiff body muscles due to stress, muscle cramps due to lack of exercises, and the like. However, for various reasons, some are unable to receive massages from professional massage therapists, and this has led into development and use of massage chairs that can be provided at home for convenient use thereof.

In addition, in recent years, there has been a growing interest in the ways to reduce fatigue of users, maintain health, and the like, which involve not only simply massaging or applying acupressure on specific body parts, but also massaging acupuncture points distributed throughout the body based on oriental medicine.

Meanwhile, each user has different physical conditions. That is, there are various factors that may influence the conditions of the body, such as height, weight, gender, age, etc., and the locations of the acupuncture points may be varied accordingly.

Therefore, it is recognized that, rather than using a massage chair, it would be more effective to have a treatment from an oriental medicine doctor in person by visiting oriental medical clinic and the like, so as to receive a massage in accordance with the accurate locations of the acupuncture points that are varied from individual to individual.

In view of the foregoing, changes are made to the massage chairs that simply massage specific body parts such as shoulders, arms, and legs by delivering a feeling of pressure through a use of an airbag or by delivering a feeling of acupressure through a use of massage balls, and accordingly, the massage chairs released recently are equipped with the function of massaging the acupuncture points.

For example, Korean Patent Publication No. 10-2011-0112922 discloses a massage chair capable of massaging acupuncture points distributed along the five meridian paths of a user's back. Specifically, the document above discloses a massage chair capable of massaging acupuncture points distributed along the user's spine, using a spinal vital energy and blood flow facilitator that is formed of a combination of a plurality of bar-shaped rods within the back support portion to apply pressure according to body weight.

However, since this type of massage chair is capable of massaging only the acupuncture points distributed along the spine and adopts a method of applying the acupressure simply with bars instead of a massage method specialized for each acupuncture point, there is a disadvantage that it is impossible to massage each acupuncture point in each part of the body, and it is also impossible to provide customized massages for each acupuncture point.

As another example, Korean Patent Publication No. 10-2016-0119995 discloses a pneumatic massager that can be used in a massage chair for the acupuncture point massage. Specifically, this pneumatic massager is provided with acupressure protrusions within the pneumatic massager that is to come into contact with the skin of the human body to perform a massage function, and also provided with acupuncture point protrusions at certain locations to massage the acupuncture points of the human body.

However, since this type of pneumatic massager can perform acupuncture point massage only at the certain locations irrespective of locations of the acupuncture points that are different from user to user, there is a disadvantage that it is impossible to provide customized acupuncture point massages to the user.

(Patent Literature 1) Korean Patent Publication No. 10-2011-0112922 (Oct. 14, 2011)

(Patent Literature 2) Korean Patent Publication No. 10-2016-0119995 (Oct. 17, 2016)

SUMMARY

Technical problem

Accordingly, a main objective of the present invention is to provide a massage chair capable of performing a customized acupuncture point massage to the locations of the acupuncture points of a user by predicting the locations of the acupuncture points varied from user to user by using a shoulder height of each user.

Technical Solution

According to an embodiment of the present invention, there is provided a massage chair including: a seat 200; a back support portion 100 rotatably mounted on one side of the seat 200; a calf massage portion 400 rotatably mounted on the other side of the seat 200; a manipulation portion 600 capable of adjusting movements of the back support portion 100 and the calf massage portion 400, in which the manipulation portion 600 includes: a shoulder height measurement module 610 for measuring a shoulder height of the user; a hip bone position prediction module 620 for predicting a hip bone position by using a preset first method with reference to the shoulder height measured by the shoulder height measurement module 610; a massage position determination module 630 for determining a plurality of massage positions based on the hip bone position predicted by the hip bone position prediction module 620; a massage mode selection module 640 for selecting one massage mode of a plurality of previously-stored massage modes based on the plurality of massage locations determined by the massage location determination module 630, thereby massaging the plurality of massage locations determined by the massage location determination module 630 in accordance with the massage mode selected by the massage mode selection module 640.

In addition, the preset first method includes when the measured shoulder height is less than a predetermined first shoulder height value, at the hip bone location prediction module 620, predicting a location of the hip bone to be a predetermined first hip bone location value, when the measured shoulder height is equal to or greater than the predetermined first shoulder height value and less than a predetermined second shoulder height value, predicting, at the hip bone location prediction module 620, the location of the hip bone to be a predetermined second hip bone location value, and when the measured shoulder height is equal to or greater than the predetermined second shoulder height value, predicting, at the hip bone location prediction module 620, the location of the hip bone to be a predetermined third hip bone location value, in which the second shoulder height value may be greater than the first shoulder height value, and the second hip bone location value may be greater than the first hip bone location value and less than the third hip bone location value.

In addition, the manipulation portion 600 may further include a massage portion drive module 632 for moving one or more of the back support portion 100, the calf massage portion 400, and a foot massage portion 500 to a plurality of massage locations determined by the massage location determination module 630, and a massage performance module 642 for controlling one or more of airbags 102, 122, 202, 204, 312, 402, 404, 406, 502, and 504, massage balls 408 and 506 and a massage ball assembly 700 in accordance with the massage mode determined by the massage mode selection module 640.

In addition, the manipulation portion 600 may further include a user information input module 650 for receiving one or more of gender information and age information of a user, and height information and weight information of the user, a BMI calculation module 660 for calculating a body mass index (BMI) using the height information and the weight information input to the user information input module 650, and a massage intensity setting module 670 for setting intensity of massage with a preset second method using the BMI calculated by the BMI calculation module 660, thereby massaging the plurality of massage positions determined by the massage position determination module 630 in accordance with the massage intensity set by the massage intensity setting module 670.

In addition, the preset second method may further include when the calculated BMI is less than a predetermined first BMI value, at the massage intensity setting module 670, setting the intensity of massage to a predetermined first value, when the calculated BMI is equal to or greater than the predetermined first BMI value and less than a predetermined second BMI value, setting, at the massage intensity setting module 670, the intensity of massage to a predetermined second value, and when the calculated BMI is equal to or greater than the predetermined second BMI value, setting, at the massage intensity setting module 670, the intensity of massage to a predetermined third value, in which the second BMI value may be greater than the first BMI value, and the second value may be greater than the first value and less than the third value.

In addition, the manipulation portion 600 may include a hip bone location correction module 680 for correcting the hip bone location predicted by the hip bone location prediction module 620 using the height information input to the user information input module 650, the massage location determination module 630 may determine a plurality of massage locations based on the hip bone location corrected by the hip bone location correction module 680, and the massage mode selection module 640 may determine a massage mode based on the plurality of massage locations determined by the massage location determination module 630.

In addition, the massage portion drive module 632 may move one or more of the back support portion 100, the calf massage portion 400, and the foot massage portion 500 in accordance with the plurality of massage locations determined by the massage location determination module 630, and the massage performance module 642 may control one or more of the airbags 102, 122, 202, 204, 312, 402, 404, 406, 502, and 504, the massage balls 408 and 506, and the massage ball assembly 700 in accordance with the massage mode determined by the massage mode selection module 640.

In addition, the plurality of massage modes may include a Hae-Ul-Cheong-Sim mode, in which, among the plurality of massage locations determined, the Hae-Ul-Cheong-Sim mode may massage one or more of acupuncture points "tae chung", "sam eum gyo", "chuk bin", "eum gok", "gyeok su", "gan su", "sim su", "pye su", "baek ho", "go hwang", "sin dang", "gyeon jeong", "pung ji", "no gung", "so bu", "sin mun", "nae gwan", and "su sam ni".

In addition, the plurality of massage modes may include an Ahn-Shin-Do-Myeon(Ahn Myeon) mode, in which, among the plurality of massage locations determined, the Ahn-Shin-Do-Myeon mode may massage one or more of acupuncture points "an myeon hyeol", "pung ji", "nae gwan", "so bu", "gyeon jeong", "sim su", "bi su", "eum neung cheon", "sam eum gyo", "nae chung", and "sil myeon".

In addition, the plurality of massage modes may include a Seo Geun Je Tong-back pain (relaxation psoas muscle) mode, in which, among the plurality of massage locations determined, the Seo Geun Je Tong-back pain mode may massage one or more of acupuncture points "eum neung cheon", "seung geun", "seung san", "dae do", "sim su", "ji sil", "dae jang su", "gwan won su", "so jang su", "gyeok su", "gong choe", "hap gok", "su sam ni", "gyeon jeong", and "pung ji".

In addition, the plurality of massage modes may include a Seo Geun Je Tong-neck pain (relaxation scapularis muscle) mode, in which, among the plurality of massage locations determined, the Seo Geun Je Tong-neck pain mode may massage one or more of acupuncture points "hyeon Jong", "gol lyun", "eum neung cheon", "seung geun", "seung san", "gyeon oe su", "gyeon Jung su", "cheon ju", "pung ji", "wan gol", "hu gye", "jung jeo", "yeol gyeol", "oe gwan", and "so sang".

In addition, the plurality of massage modes may include a Saeng-Hyeol-Bal-Gi(vitality) mode, in which, among the plurality of massage locations determined, the Saeng-Hyeol-Bal-Gi mode may massage one or more of acupuncture points "yong cheon, "tae gye", "jok sam ni", "hyeol hae", "so bu", "gyeon jeong", "gan su", "bi su", "sim su", "sang nyo" and "cha ryo".

In addition, the plurality of massage modes may include a Geon-Wi-So-Sik(Geon-Wi) mode, in which, among the plurality of massage locations determined, the Geon-Wi-So-Sik mode may massage one or more of acupuncture points "tae chung", "jok sam ni", "pung nyung", "sam eum gyo", "hap gok", "nae gwan", "so bu", "su sam ni", "dok su", "gyeok su", "gan su", "dam su", "bi su", "wi su", "sam cho su", "gyeok gwan", baek mun, "yang gang", "ui sa", "wi chang", "gyeon jeong", "gyeon Jung su", "gyeon oe su", "cheon jeong" and "pung ji".

In addition, the plurality of massage modes may include a So-Jong-Mi-Gak(Mi-Gak) mode, in which, among the plurality of massage locations determined, the So-Jong-Mi-Gak mode may massage one or more of acupuncture points "tae yeon", "sin mun", "gong choe", "oe gwan", "su sam ni", "gyeon jeong", "pung ji", "bu bun", "baek ho", "go hwang", "sam cho su", "bang gwang su", "gyeok su", "jung do", "sam eum gyo", "su cheon", "bu lyu" and "eum neung cheon".

Advantageous Effects

According to the present invention, the hip bone location of a user is predicted based on the height of the shoulder of a user, the location of the acupuncture point is predicted based on the predicted location of the hip bone to perform a massage, so that it is possible to provide a customized massage to the locations of the acupuncture points which vary from user to user.

In addition, it is possible to further improve the accuracy of predicting the location of the acupuncture point by correcting the predicted hip bone location using the height information of the user.

In addition, the massage intensity can be adjusted through the information of height, weight, age, gender, and the like of the user, thereby providing an optimal intensity of massage to the user.

Furthermore, the acupuncture points may be massaged in ways different from each other using airbags or massage balls on each acupuncture point, thereby providing acupuncture point massage customized to the characteristics of each acupuncture point.

BRIEF DESCRIPTION OF THE DRAWINGS

FIG. 4 is a view showing acupuncture points located in the vicinity of the vertebral bones of FIG. 3 and massage balls for massaging each acupuncture point.

FIG. 5 is a view showing acupuncture points located in the body parts other than the vertebral bones.

FIG. 6 is a view showing locations of the airbags for massaging the acupuncture points of FIG. 5.

DETAILED DESCRIPTION

Figure 1:
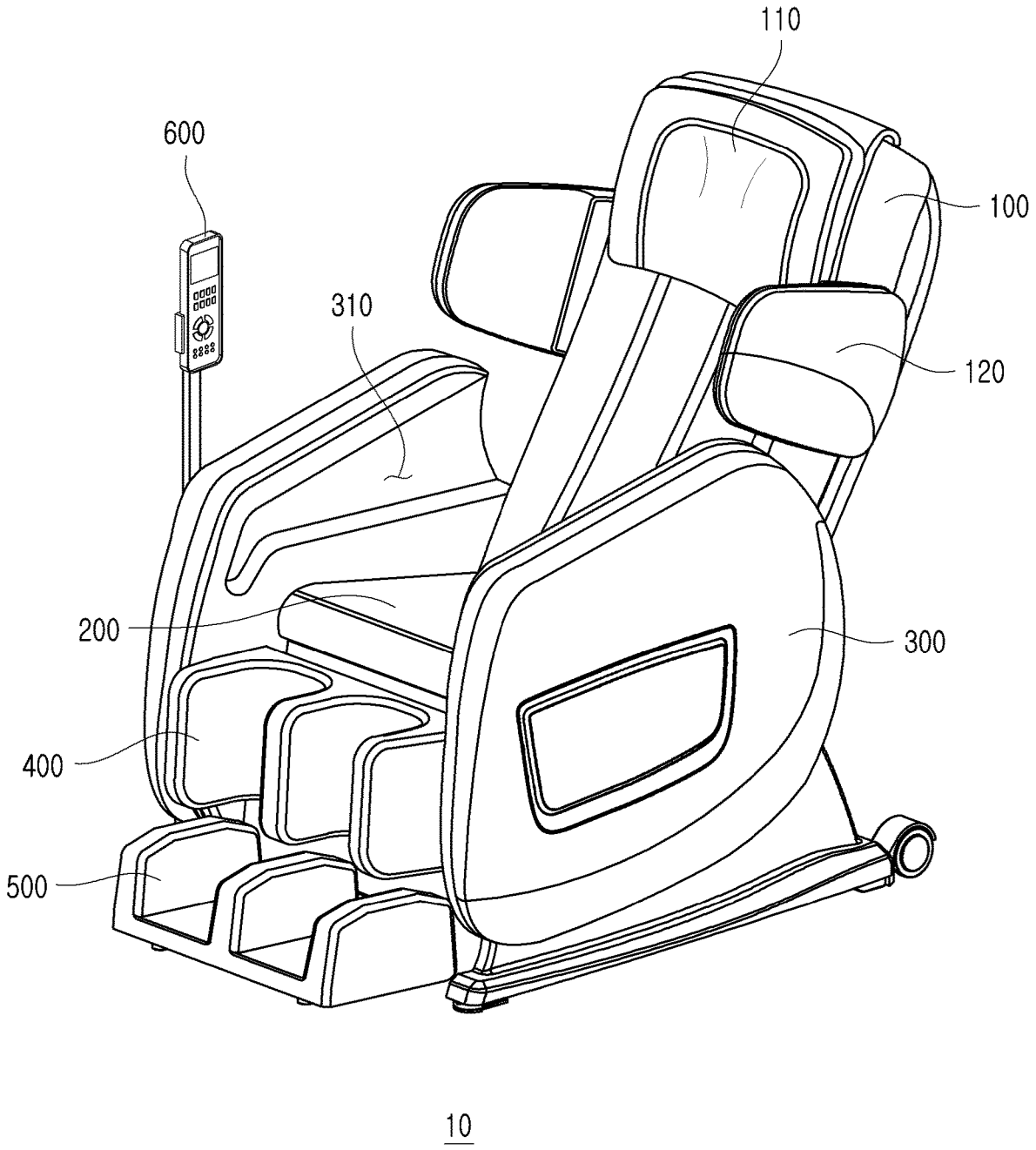
FIG. 1 is a perspective view showing a massage chair according to an embodiment of the present invention.

Hereinafter, the present invention will be described in detail with reference to the accompanying drawings.

1. Definition of Terms

Assuming that the user is seated on a massage chair 10 in the accompanying drawings, it is described that an upper portion of the user is an upper side, a lower portion of the user is a lower side, a direction that the user is seeing is a front side, and a direction that the back of the user is faced is a rear side.

A back support portion 100, a calf massage portion 400, and a foot massage portion 500, which will be described below, can be rotated or moved up and down, respectively, and for this purpose, a separate actuator (not shown) is provided, which is a known technology, and thus will not be described in detail about its principle of operation.

In addition, selection and change of massage modes in accordance with a manipulation portion 600 (to be described below), and the corresponding operation of the massage chair 10 are performed when a signal is applied to the manipulation portion 600 and the corresponding signal is transmitted to a control unit (not shown), which is also a known technology and thus will not be described in detail about its principle of operation.

In the following description, the term "acupressure" refers to a massage method that imparts a pressing stimulus in a manner of pressing the narrowest spot with a thumb.

In addition, the term "palm-pressure" refers to a massage method that imparts a pressing stimulus in a manner of pressing an acupuncture point and a slightly wider range therearound, using a protruding part of the palm below the thumb.

In addition, the term "compression" refers to a massage method that imparts a pressing stimulus in a manner of pressing the widest part, that is, the thigh muscles, lower limb calf muscles, and the like with the entire palm.

In addition, the term "rubbing" refers to a massage method that imparts a stimulus in a manner of rubbing by using a thumb, an edge of a hand, a protruding part of the palm below a thumb, or the entire palm in accordance with the body part.

In addition, the term "kneading" refers to a massage method that imparts a stimulus in a manner of kneading by using a thumb and an index finger, or by using all five fingers in accordance with the body part.

In addition, the term "rolling" refers to a massage method that imparts a rolling stimulus to a palm or a wide muscle surface by using a roller or the like.

In addition, the term "instantaneous massage" refers to a massage method that rapidly taps a body part with an edge of a hand, and it includes "instantaneous palm-pressure" and "instantaneous compression".

In addition, the term "major stimulation Chuna" refers to a Chuna stimulation method that imparts a Chuna stimulus of medium or high intensity to a target where the stimulation mode is intended to be applied, which can produce a therapeutic effect during the alternating procedures. The major stimulation Chuna may be used to stimulate major acupuncture points.

In addition, the term "minor stimulation Chuna" refers to a Chuna stimulation method that imparts a low intensity Chuna stimulus, which can produce a stabilizing effect during the alternating procedures. The minor stimulation Chuna is a background Chuna stimulus that maintains therapeutic effect by preventing the user from having a tension reaction to the major stimulation Chuna that produces a therapeutic effect, and it may be used to stimulate the rest of the acupuncture points other than the main acupuncture points.

2. Description of Massage Chair

Figure 2:
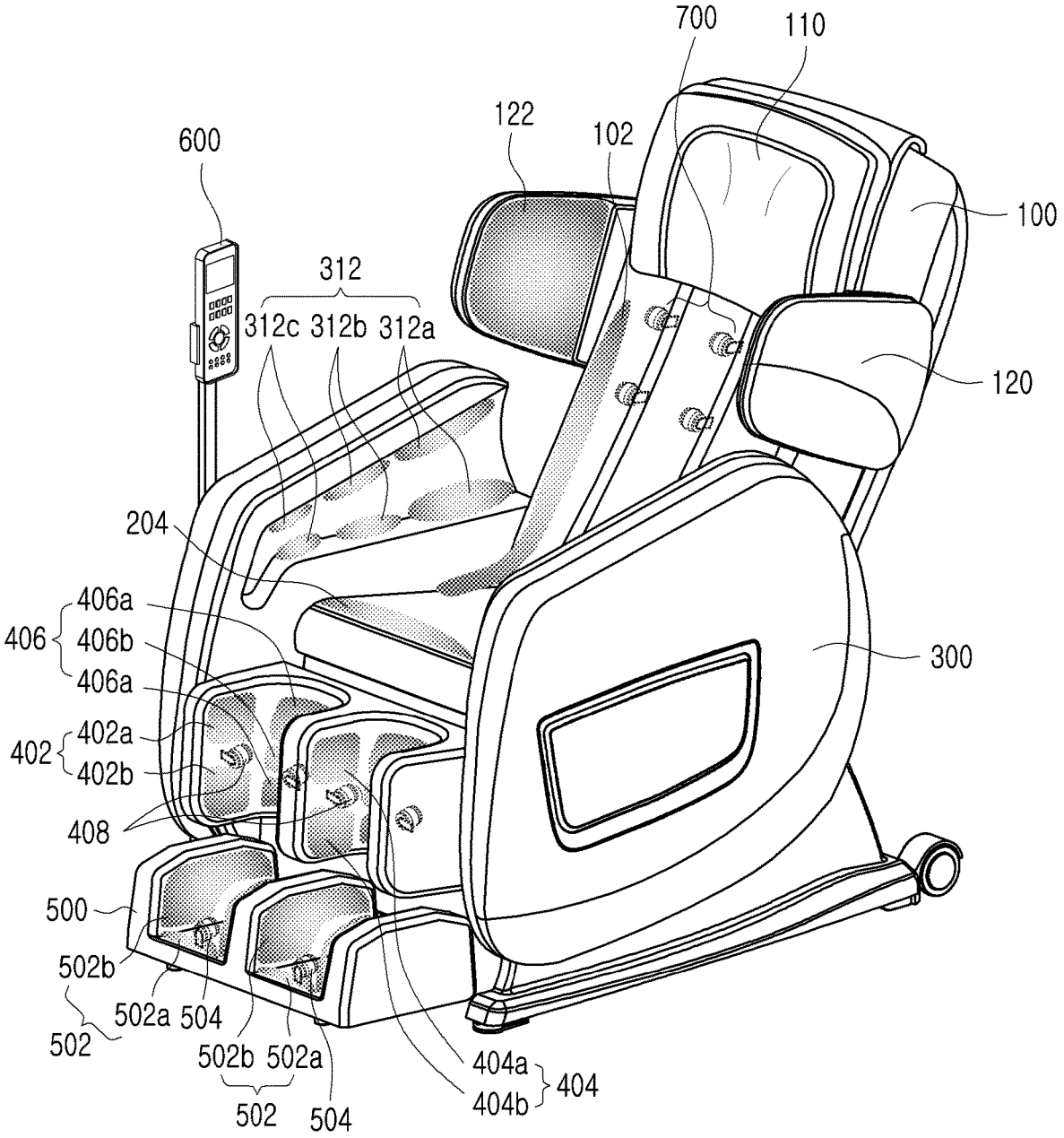
FIG. 2 is a perspective view showing airbags of the massage chair according to an embodiment of the present invention.

Referring to FIGS. 1 and 2, a massage chair 10 according to the embodiment shown includes a back support portion 100, a seat 200, support frames 300, calf massage portions 400, foot massage portions 500 and a manipulation portion 600.

The back support portion 100 supports the back of the user and may be adjusted relatively at a predetermined angle with respect to the seat 200 and the support frame 300.

A headrest 110 is positioned at the upper portion of the back support portion 100, so that the head of the user is placed thereon.

A pair of shoulder massage portions 120 is formed on both left and right sides of the headrest 110 of the back support portion 100, and shoulder airbags 122 are respectively positioned on the shoulder massage portions 120 to compress the shoulders.

In the back support portion 100, a pair of back airbags 102 is positioned on at the left and right sides of the back support portion 100, which are formed in an elongated shape to the upper and lower sides of the back support portion 100 and are continued down to the seat 200 which will be described below. The back airbags 102 may press the left and right sides of the back of the user, and may press the pelvis of the user as will be described below.

The pressure and amount of the air applied to various airbags 202, 204, 312, 402, 502, and 504 to be described below, including the back airbags 102 and the shoulder airbags 122, may be adjusted.

The seat 200 is a portion where the hip and the upper portion of the thigh of the user come in contact, and is generally fixed to the support frame 300. The seat 200 is preferably formed of a material that can provide a feeling of cushion.

The back airbags 102 are extended to and positioned at the left and right inside the seat 200. Therefore, the back airbags 102 may compress not only the back of the user but also the pelvis part of the user.

Thigh airbags 204 are positioned at the front side of the seat 200. The thigh airbags 204 may press the backs of the thighs of the user seated on the seat 200.

The support frames 300 are positioned on the left and right sides of the seat 200, and firmly fix the massage chair 10 as a whole even during the operation of the back support portion 100 and the calf massage portions 400 and also during the operation of the foot massage portions 500. To this end, a bracket (not shown) for fixing the massage chair 10 on the floor may be positioned at the bottom of the support frame 300.

Arm massage portions 310 are formed at the left and right inner sides of the support frame 300. The arm massage portions 310 are where the arms of the user are inserted during the massage process after the user is seated on the massage chair 10.

Arm airbags 312 are positioned inside the arm massage portions 310. One arm airbag 312 may be formed of a pair of upper and lower airbags, respectively, or, each of the upper and lower pairs of airbags may be formed of a pair of left and right airbags, respectively, in which case one arm airbag 312 may be formed of a total of four airbags.

As will be described below, the arm airbag 312 according to an embodiment of the present invention may include first arm airbags 312*a*, second arm airbags 312*b*, and third arm airbags 312*c* on the upper and lower sides, respectively, to massage various acupuncture points located in the arm part.

The calf massage portions 400 are provided for massaging the leg part of the user, specifically, the calf part of the lower knee. The calf massage portions 400 are provided with a pair of grooves so that the calves of the user can be inserted therein.

The calf massage portions 400 are movable relatively at a predetermined angle with respect to the seat 200 and the fixed support frame 300.

Outer calf airbags 402, inner calf airbags 404, and rear calf airbags 406 are positioned inside the grooves of the calf massage portions 400, respectively.

More specifically, when it is assumed that the calves of the user are inserted into the calf massage portions 400, there are outer calf airbags 402 positioned so as to press the outside of the calves of the user, inner calf airbag 404 positioned so as to press the inside of the calves of the user, and rear calf airbags 406 positioned so as to press the rear side of the calves of the user.

As will be described below, each of the calf airbags 402, 404, and 406 according to an embodiment of the present invention may include additional airbags 402*a*, 402*b*, 404*a*, 404*b*, 406*a*, and 406*b* on the upper and lower sides, respectively, to massage various acupuncture points located in the calf part.

Calf massage balls 408 are mounted on both side surfaces of the grooves inside of the calf massage portions 400. As will be described below, the calf massage balls 408 may massage the acupuncture points located in the calf along with the calf airbags 402, 404, and 406. A separate control and driving means (not shown) may be included to drive the calf massage balls 408.

The foot massage portions 500 are positioned at lower ends of the calf massage portions 400. The foot massage portions 500 are provided with a pair of grooves so that the feet can be inserted for the purpose of massage of the foot parts after the user is seated on the massage chair 10.

In the illustrated embodiment, the foot massage portions 500 are provided integrally with the calf massage portions 400. The foot massage portions 500 may be relatively moved up and down with respect to the calf massage portions 400, so that the foot massage portions 500 may be properly adjusted in accordance with the body size of the user (that is, the length of the leg, the calf, or the thigh).

Alternatively, the foot massage portions 500 may also be provided separately from the calf massage portions 400.

Foot airbags 502, sole airbags 504, and sole massage balls 506 are positioned inside the grooves of the foot massage portions 500.

The foot airbags 502 compress the front and back and the instep of the foot. As will be described below, the foot airbags 502 may include front foot airbags 502*a* and instep airbags 502*b* to massage various acupuncture points located at the foot part.

The sole airbags 504 compress the sole.

The sole massage balls 506 are mounted inside the sole airbag 504 to enable a massage by the sole massage balls 506, in addition to the massage by the sole airbags 504.

The manipulation portion 600 is provided for the user to manipulate the operation of the massage chair 10 and may include a button or a touch panel. In addition, a display window for allowing the user to check an operating state of the massage chair 10 may be provided.

In the illustrated embodiment, the manipulation portion 600 may be provided on the right side of the massage chair 10 and operable with the right hand, or alternatively, may be provided on the left side and operable with the left hand.

A connection portion connects the manipulation portion 600 to the massage chair 10, and is preferably made of a material that is hard and changeable in shape to some extent at the same time, and may include a cable (not shown) connecting the manipulation unit 600 to a control unit (not shown) inside the massage chair 10 mounted inside.

The user may select various massage modes through the manipulation portion 600 to thus apply the signals to the control unit, and accordingly, the manipulation portion 600 transmits a signal corresponding to the massage mode to the control unit.

Upon received in the control unit, the signal may activate an actuator (not shown) or the like of the massage chair 10 to operate the back support portion 100, the calf massage portions 400, and the foot massage portions 500, or to inject the air into the various airbags 102, 122, 202, 204, 312, 402, 404, 406, 502, and 504.

In addition, the user may apply a signal to the control unit through the manipulation portion 600 to adjust the intensity of massage or to control the movement of the massage ball assembly 700 for the acupuncture point massage which will be described below.

In an embodiment of the present invention, the manipulation portion 600 includes various modules 610, 620, 630, 640, 650, 660, 670, and 680 capable of predicting the locations of the acupuncture points, and massaging the predicted locations of the acupuncture points. This will be described below.

3. Description of Acupuncture Points in Body and Massage Methods Thereof

Unlike the related massage chair, the massage chair 10 according to an embodiment of the present invention can perform acupuncture point massage in accordance with the characteristics of each acupuncture point located in the body. To understand this, hereinafter, the acupuncture points in the body and the massage methods of each acupuncture point will be described.

Figure 3:
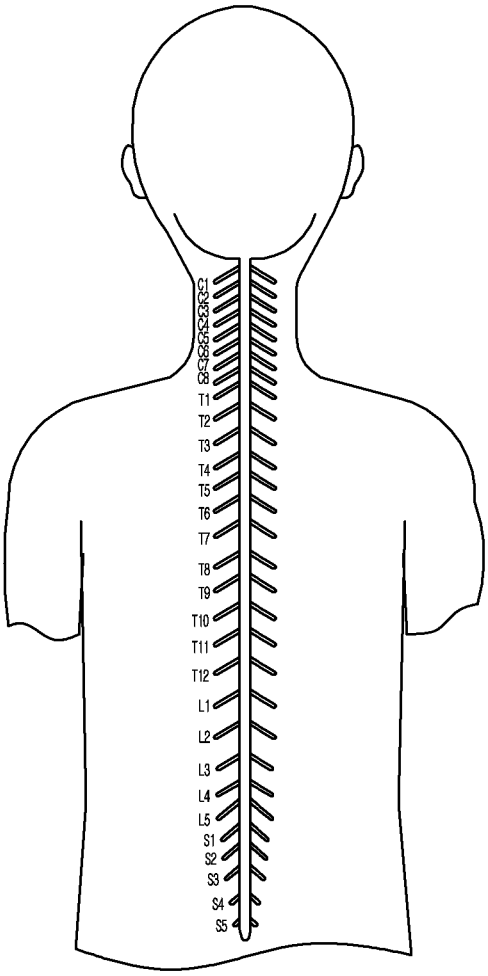
FIG. 3 is a view showing respective locations of the vertebral bones of the body.

1) Description of Acupuncture Points Located in the Vicinity of Vertebral Bones and Massage Methods Thereof Referring to FIGS. 3 and 4, the vertebral bones may be classified into C1 to S5, and the locations of the acupuncture points may be displayed based on the classified locations. In the following description, the terms C1 to S5 may be used to refer to the meaning that includes not only the corresponding spinal parts but also an area therearound.

Between C1 and C2, there is "an myun". The acupuncture point "an myun" may be massaged by a method including the kneading or the acupressure. More specifically, massage may be performed by imparting the kneading stimulus to the left or right side based on the center line of the cervical spine, or by imparting the acupressure to the acupuncture point area.

In addition, there is "pung bu" located between C1 and C2. The acupuncture point "pung bu" may be massaged by a method including the rubbing or the acupressure. More specifically, massage may be performed by imparting the rubbing stimulus to the left or right side based on the center line of the cervical spine, or by imparting the acupressure to the acupuncture point area. At this time, since it is difficult to massage directly the exact "pung bu" area, massage may be performed indirectly by imparting a kneading stimulus or an acupressure stimulus to the nearest left and right areas.

There is "cheon ju" located at C2. The acupuncture point "cheon ju" may be massaged by a method including the kneading or the acupressure. More specifically, massage may be performed by imparting a kneading stimulus or an acupressure to an area of about 2 cm to the left and right sides of the midline part.

In addition, there is "pung ji" located at C2. The acupuncture point "pung ji" may be massaged by a method including the kneading or the acupressure. More specifically, massage may be performed by imparting the kneading stimulus or the acupressure to left and right sides of a 2/2 point of an extension line between the midline and the acupuncture point "wan gol" under the mastoid process below the ear.

There is "gyeon jeong" located at C7. The acupuncture point "gyeon jeong" may be massaged by applying a kneading stimulus or by a method of the acupressure.

In addition, there is "gyeon jung su" located at C7. The acupuncture point "gyeon jung su" may be massaged by applying a rubbing stimulus or by a method of the acupressure.

The acupuncture points "an myun", "pung bu", "cheon ju", "pung ji", "gyeon jeong", and "gyeon jung su" described above are massaged by upper massage balls 720 of a massage ball assembly 700 (to be described below), which will be described below.

The acupuncture points at locations T1 to L5 may be massaged in the same way. The acupuncture points located at each spine part and massage method thereof may be described as follows.

There are "gyeon oe su" located at T1, "ji su" located at T2, and "sim su" located between T5 and T6. There are "yeong dae" located between T6 and T7, and "dok su" and "ui hoe" located between T7 and T8. There are "gyeok su", "gyeok gwan", and "ji yang" located between T8 and T9, and "hon mun" and "gan su" located between T9 and T10.

There are "dam su" and "yang gang" located between T10 and T11, and "bi su" and "ui sa" located between T11 and T12. There are "wi su" and "wi chang" located between T12 and L1. There are "sam cho su" located between L1 and L2, and "sim su", "ji sil" and "myeong mun" located between L2 and L3, and "gi hae su" located between L3 and L4, and and "dae jang su" located between L4 and L5.

In addition, there are "gwan won su" located between L4 and the sacrum bone, and "so jang su" and "bang gwang su" located at the sacrum bone.

The acupuncture points of the part ranging from T1 to L5 described above may be massaged by a method of imparting the acupressure, acupressure and rubbing, and instantaneous palm-pressure. More specifically, massage may be performed by imparting the rubbing stimulus to the line 1 of "bang gwang gyeong", and by imparting the acupressure or rubbing stimulus to the acupuncture point and the area around the acupuncture point. Alternatively, massage may be performed by imparting the kneading stimulus and instantaneous compression stimulus to the line 1 of "bang gwang gyeong", to acupuncture point, and to the area around the acupuncture point.

In addition, the acupuncture points at the location of the sacrum bone and coccyx (S1 to S5) may be massaged in the same way. The acupuncture points located at each spine part and massage method thereof can be described as follows.

There is "sang nyo" located at sacrum bone, and "mi gol dan" and "cha ryo" located at the coccyx.

The acupuncture points "sang nyo", "mi gol dan" and "cha ryo" may be massaged by the method including the acupressure or rubbing. More specifically, massage may be performed by imparting the rubbing stimulus to the left or right side with respect to the spinal center line. Alternatively, massage may be performed by imparting the acupressure or the kneading stimulus to the acupuncture point area.

In addition, being located at the distal end of the coccyx, the "mi gol dan" is difficult to massage, and for this, massage may be performed indirectly by imparting the kneading stimulus to the left and right sides nearest thereto.

The acupuncture points "gyeon oe su", "ji su", "sim su", "yeong dae", "dok su", "ui hoe", "gyeok su", "gyeok gwan", "ji yang", "hon mun", "gan su", "dam su", "yang gang", "bi su", "ui sa", "wi su", "wi chang", "sam cho su", "sim su", "ji sil", "myeong mun", "gi hae su", "dae jang su", "gwan won su", "so jang su", "bang gwang su", "sang nyo", "mi gol dan", and "cha ryo" described above are massaged by the lower massage balls 730 of the massage ball assembly 700 (to be described below), which will be described below.

(2) Description of Acupuncture Points Located Elsewhere Other than the Vicinity of Vertebral Bones and Massage Methods Thereof The acupuncture points that are not located elsewhere other than the vicinity of the vertebral bones, and the massage method thereof will be described with reference to FIGS. 5 and 6.

Examples of the acupuncture point line include the line 1 of "bang gwang gyeong" and the line 2 of "bang gwang gyeong". The line 1 of "bang gwang gyeong" and the line 2 of "bang gwang gyeong" may be massaged by imparting the rubbing stimulus, respectively. More specifically, massage may be performed by imparting the rolling stimulus or simultaneously imparting the kneading stimulus and the rolling stimulus. Alternatively, massage may be performed by additionally delivering the feeling of warmth.

1) Description of Acupuncture Points at Arm and Hand Parts and Massage Methods Thereof The acupuncture points "no gung", "so bu", "nae gwan", "hap gok", "gong choe", "hu gye", "jung jeo", "oe gwan", "yeol gyeol", "tae yeon", "sin mun", "so sang", and "su sam ni" are located at the arm and hand parts.

The acupuncture points described above may be massaged by imparting the kneading stimulus or the instantaneous compression stimulus. More specifically, massage may be performed by imparting the compression stimulus in a kneading pattern or by imparting the instantaneous compression stimulus.

2) Description of Acupuncture Point at Thigh Part and Massage Methods Thereof

The acupuncture point "eum gok" is located at the thigh part and may be massaged by imparting a rhythmic compression stimulus. More specifically, rather than imparting the compression stimulus continuously, massage may be performed by generating a compressed state and an uncompressed state alternately.

3) Description of Acupuncture Points at Calf Part and Massage Methods Thereof

The acupuncture points "yang neung cheon", "jok sam ni", "pung nyung", "eum neung cheon", "chuk bin", "bu lyu", "seung san", and "seung geun" are located at the calf part.

The acupuncture points "yang neung cheon", "jok sam ni", "pung nyung", "eum neung cheon", "chuk bin", and "bu lyu" may be massaged by imparting the kneading stimulus or by imparting the instantaneous compression stimulus. More specifically, massage may be performed by imparting the compression stimulus in a kneading pattern or by imparting the instantaneous compression stimulus.

The acupuncture points "seung san" and "seung geun" may be massaged by imparting the rhythmic compression stimulus. More specifically, rather than imparting the compression stimulus continuously, massage may be performed by generating a compressed state and an uncompressed state alternately.

4) Description of Acupuncture Points at Foot Part and Massage Methods Thereof

The acupuncture points "jung do", "dae do", "gol lyun", "hyeon jong", "sam eum gyo", "tae gye", "bu lyu", "su cheon", "tae chung", "yong cheon", "sil myeon", and sole are located at the foot part.

The acupuncture points "jung do", "dae do", "gol lyun", "hyeon jong", "sam eum gyo", "tae gye", "bu lyu", and "su cheon" may be massaged by imparting the kneading stimulus or by imparting the instantaneous compression stimulus. More specifically, massage may be performed by imparting the compression stimulus in a kneading pattern or by imparting the instantaneous compression stimulus.

The acupuncture point of "tae chung" may be massaged by imparting the rhythmic compression stimulus or the instantaneous compression stimulus. More specifically, rather than imparting the compression stimulus continuously, massage may be performed by generating a compressed state and an uncompressed state alternately, or may be performed by imparting an instantaneous compression stimulus.

The acupuncture points "yong cheon", "sil myeon", and sole may be massaged by imparting the rolling stimulus or an air compression stimulus. More specifically, massage may be performed through the rolling stimulus, but without the rolling, massage may be performed by imparting the compression stimulus.

(3) Description of Massage Method in Accordance with Each Chuna Stimulus Type

The type of the Chuna stimulus may be largely classified into acupressure, palm-pressure, compression, rubbing, kneading, rolling, and instantaneous massage, and the method of the Chuna stimulus may be largely classified into major stimulation Chuna and minor stimulation Chuna. Hereinafter, a massage method in accordance with the type of each Chuna stimulus will be described for each location of acupuncture points.

1) Description of Massage Method for Acupressure

The acupressure with respect to the acupuncture points located in the vicinity of the vertebral bones may be performed by stimulating the acupuncture point with the massage balls 720 and 730 and the heating element 770 of the massage ball assembly 700 and the back airbag 102 to be described below.

The acupressure with respect to the acupuncture points located at the body parts other than the vicinity of the vertebral bones may be performed by continuously stimulating a narrow area with the airbags 204, 312, 402, 404, 406, 502, and 504, and protrusions 410 and massage balls 408 and 506 formed therein, which will be described below.

In addition, the acupuncture point located at the sole of the foot may be performed by stimulating the acupuncture point with sole massage balls 506.

2) Description of Massage Method for Palm-pressure

The palm-pressure with respect to the acupuncture points located in the vicinity of the vertebral bones may be performed by, in addition to the movement for the acupressure described above, the kneading with the massage balls 720 and 730 and the heating elements 770 of the massage ball assembly 700 to be described below.

3) Description of Massage Method for Compression

The compression with respect to the acupuncture points located in the vicinity of the vertebral bones may be performed by stimulating the acupuncture point with the back airbags 102, the massage balls 720 and 730, and the heating element 770 of the massage ball assembly 700 to be described below. At this time, the lower massage ball 730 and the heating element 770 may also be simultaneously moved to perform the compression with respect to the acupuncture points.

The compression with respect to the acupuncture points located at the body parts other than the vicinity of the vertebral bone may be performed by simultaneously stimulating the acupuncture points and the wide area around the acupuncture points by air injection of the airbags 204, 312, 402, 404, 406, 502 and 504 to be described below.

4) Description of Massage Method for Rubbing

The rubbing with respect to the acupuncture point located in the vicinity of the vertebral bones may be performed by stimulating the acupuncture point with the massage balls 720 and 730, and the heating element 770 of the massage ball assembly 700 to be described below.

Specifically, the massage balls 720 and 730 are circularly moved by the movement of the massage ball assembly 700 to be described below, and the rubbing is performed with respect to the target acupuncture point. Further, the stimulation of acupuncture point by the heating element 770 may be additionally performed to change the intensity of the rubbing.

5) Description of Massage Method for Kneading

The kneading with respect to the acupuncture point located in the vicinity of the vertebral bones may be performed by stimulating the acupuncture point with the massage balls 720 and 730, and the heating element 770 of the massage ball assembly 700 to be described below.

Specifically, the kneading movement of the massage balls 720 and 730 is formed by the movement of the massage ball assembly 700 to be described below to perform the kneading with respect to the target acupuncture point. Further, the stimulation of acupuncture point may be additionally performed by the heating element 770 to change the intensity of the kneading.

The kneading with respect to acupuncture points located in the body parts other than the vicinity of the vertebral bones may be performed with the airbags 204, 312, 402, 404, 502, and 504 and the calf massage balls 408 to be described below.

Specifically, the body parts may be inserted between each of the airbags 312, 402, 404, 502, and 504 provided in pairs, and air may be injected into each of the airbags 312, 402, 404, 502, and 504, so that kneading is performed as the stimulation is repeated on both sides of the body parts inserted.

The thigh airbag 204 is elongated to the left and right sides of the front surface of the seat 200, so that the process of changing an amount of air injection into the left and right thigh airbags 204 differently from each other may be continuously performed to perform the kneading.

In addition, in the case of the calf part, the kneading may be performed by the compression by the calf airbags 402 and 404 added by the stimulations to both sides of the calf by the calf massage balls 408.

6) Description of Massage Method for Rolling

The rolling with respect to the acupuncture point located in the vicinity of the vertebral bones may be performed by stimulating the acupuncture point with the massage balls 720 and 730, and the heating element 770 of the massage ball assembly 700 to be described below.

Specifically, the massage balls 720 and 730 are moved up and down while rotating by the movement of the massage ball assembly 700 to be described below, to perform rolling with respect to the target acupuncture point.

The rolling with respect to acupuncture points located at body parts other than the vicinity of the vertebral bones may be performed with the calf massage balls 408 and the sole massage balls 506.

Specifically, the calf massage balls 408 and the sole massage balls 506 are moved up and down while rotating to perform the rolling with respect to the target acupuncture point located at the calf part and the sole part, respectively.

7) Description of Massage Method for Instantaneous Massage

The instantaneous massage with respect to the acupuncture point located in the vicinity of the vertebral bones may be performed by stimulating the acupuncture point with the massage balls 720 and 730, and the heating element 770 of the massage ball assembly 700 to be described below.

Specifically, the massage balls 720 and 730 and the heating element 770 may be moved together with each other by a tapping movement of a massage bundle 740 of the massage ball assembly 700 to perform tapping with respect to the target acupuncture point.

The instantaneous massage with respect to acupuncture points located in the body parts other than the vicinity of the vertebral bones may be performed with the airbags 204, 312, 402, 404, 406, 502, and 504 to be described below.

Specifically, by rapidly injecting air into each of the airbags 204, 312, 402, 404, 406, 502, and 504 to increase the compression rate by the airbags 204, 312, 402, 404, 406, 502, and 504, the instantaneous massage may be performed with respect to the acupuncture point.

4. Description of Massage Method with Airbag

Figure 7:
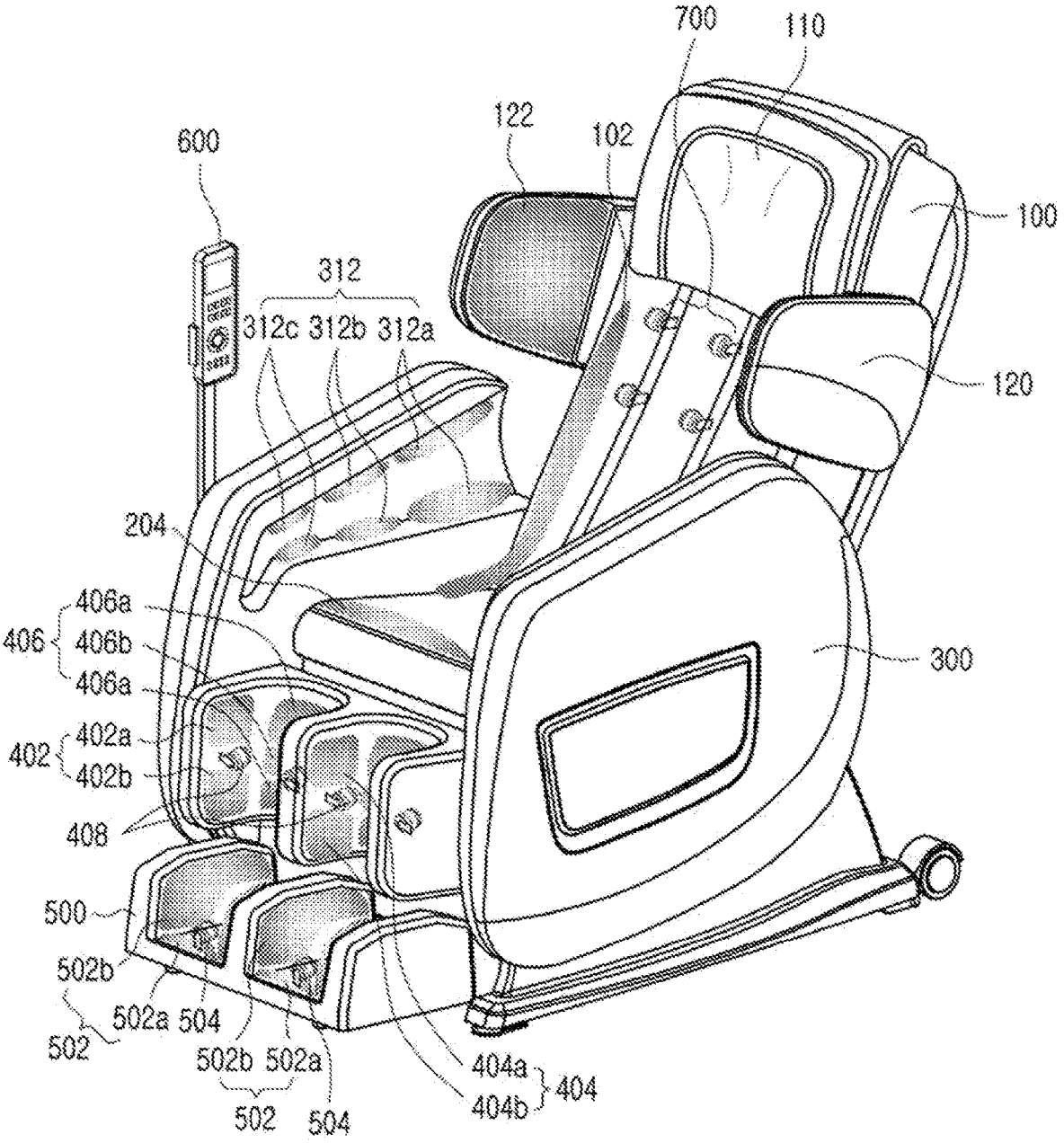
FIG. 7 is a perspective view showing the locations of the airbags of FIG. 6.

Referring to FIG. 7, the massage chair 10 according to the embodiment illustrated therein includes airbags 204, 312, 402, 404, 406, 502, and 504 capable of massaging the acupuncture points described above. Massage of each part to be described below with reference to FIGS. 7 to 10 may be performed according to the acupuncture point massage methods described in 3.

(1) Description of Acupuncture Point Massage Method with Respect to Arm Part

The arm airbags 312 includes a first arm airbag 312*a*, a second arm airbag 312*b*, and a third arm airbag 312*c*.

The first arm airbag 312*a* is located closest to the user, when it is assumed that the user is seated on the massage chair 10 with his or her arm inserted in the arm massage portion 310. The first arm airbag 312*a* may massage the acupuncture points "gong choe" and "su sam ni" through air injection.

The second arm airbag 312*b* is located at the front side of the massage chair 10 and adjacent to the first arm airbag 312*a*. The second arm airbag 312*b* may massage the acupuncture points "so sang", "hap gok", "hu gye", "jung jeo", "so bu", "nae gwan", "oe gwan", "yeol gyeol", "no gung", "sin mun", and "tae yeon" through air injection.

The third arm airbag 312*c* is located at the front side of the massage chair 10 and adjacent to the second arm airbag 312*c*. The third arm airbag 312*c* may massage the acupuncture points "so sang", "hap gok", "hu gye", "jung jeo", "so bu", "no gung", "sin mun" and "tae yeon" through air injection.

(2) Description of Acupuncture Point Massage Method with Respect to Thigh Part

The thigh airbag 204 is located in the seat 200.

The thigh airbag 204 is in contact with the back of the thigh when the user is seated on the massage chair 10, and may massage the acupuncture point such as "eum gok" through air injection.

(3) Description of Acupuncture Point Massage Method with Respect to Calf Part

Figure 8:
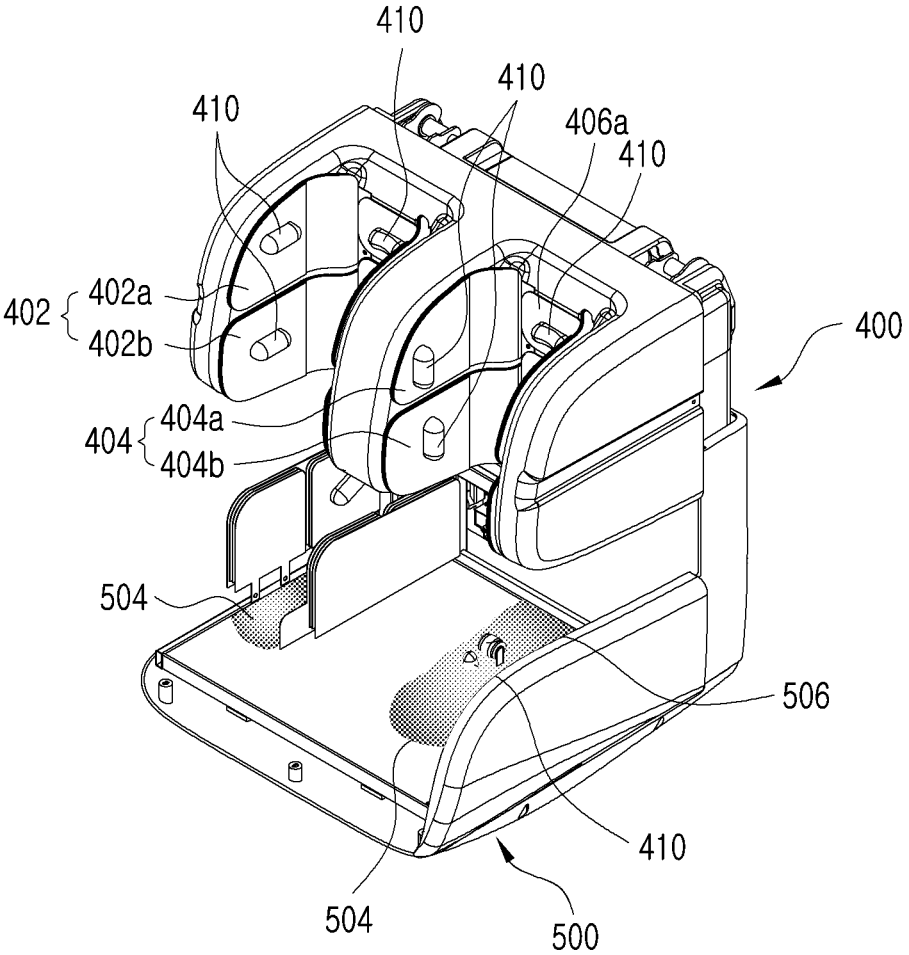
FIG. 8 is a perspective view showing a calf massage portion and a foot massage portion of the massage chair of FIG. 1.

Referring to FIGS. 7 and 8, the calf massage portion 400 includes outer calf airbags 402, inner calf airbags 404, and rear calf airbags 406.

The outer calf airbags 402 are positioned on an inner surface of an outer side of the calf massage portion 400 to massage the outer part of the calf when the user is seated on the massage chair 10 with his or her calf inserted in the calf massage portion 400, and includes a first outer calf airbag 402*a* and a second outer calf airbag 402*b*.

The first outer calf airbag 402*a* is positioned at an upper side of the inner surface of the outer side of the calf massage portion 400, and may massage the acupuncture points "yang neung cheon" and "jok sam ni" through air injection.

The second outer calf airbag 402*b* is located below the first outer calf airbag 402*a* and may massage the acupuncture point "pung nyung" through air injection.

The inner calf airbag 404 is located on an inner surface of an inner side of the calf massage portion 400 to massage the inner part of the calf when the user is seated on the massage chair 10 with his or her calf inserted in the calf massage portion 400, and includes a first inner calf airbag 404*a* and a second inner calf airbag 404*b*.

The first inner calf airbag 404*a* is located on an upper portion of the inner surface of the inner side of the calf massage portion 400 and may massage the acupuncture points "eum neung cheon" and "jung do" through air injection.

The second inner calf airbag 404*b* is located below the first inner calf airbag 404*a* and may massage the acupuncture points "chuk bin", "jung do" and "bu lyu" through air injection.

The rear calf airbags 406 are positioned on an inner surface of the rear side of the calf massage portion 400 to massage a rear side of the calf when the user is seated on the massage chair 10 with his or her calf inserted in the calf massage portion 400, and includes a first rear calf airbag 406*a* and a second rear calf airbag 406*b*.

The first rear calf airbag 406*a* is provided as a pair and positioned respectively on upper and lower sides of an inner surface of the rear side of the calf massage portion 400, and may massage the acupuncture point "seung san" through air injection.

The second rear calf airbags 406*b* are respectively positioned between the first rear calf airbags 406*a*, and may massage the acupuncture point "seung geun" through air injection.

(4) Description of Acupuncture Point Massage Method with Respect to Foot Part

Figure 9:
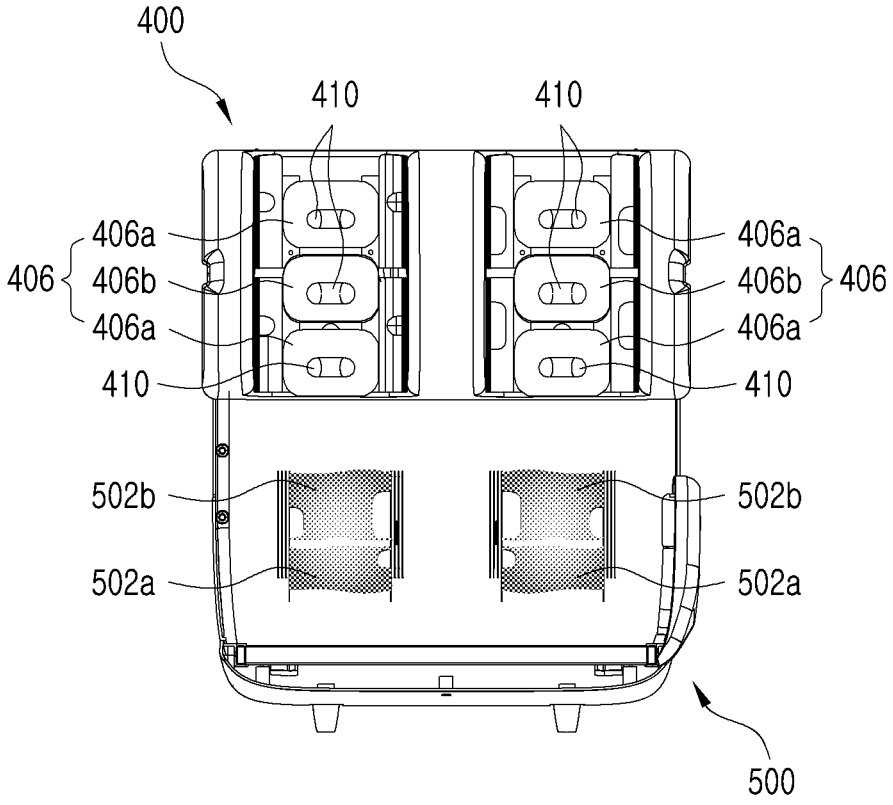
FIG. 9 is a front view showing the calf massage portion and the foot massage portion of the massage chair of FIG. 1.

Referring to FIG. 9, the foot massage portion 500 includes foot airbags 502 and sole airbags 504.

The foot airbags 502 include front foot airbags 502*a* formed on an inner surface of a front side of the foot massage portion 500, and instep airbags 502*b* formed along inner surfaces of both sides and an inner surface of a rear side of the foot massage portion 500.

The front foot airbags 502*a* may massage the acupuncture points "jung do" and "dae do" through air injection. The front foot airbags 502*a* may be rotatably formed at a front side of the foot massage portion 500 to cover both a front part and an instep of the foot inserted in the foot massage portion 500.

The instep airbags 502*b* may massage the acupuncture points "gol lyun", "hyeon jong", "sam eum gyo", "tae gye", "bu lyu", "su cheon", "tae chung" through air injection.

At this time, the instep airbags 502*b* may massage not only the instep part but also the heel part through air injection. To this end, a space (not shown) may be formed below the foot airbags 502 such that the front foot airbags 502*a* wrap around the front parts of the feet, and the instep airbags 502*b* wrap around all of the instep part, the side part of the foot, and the back part of the foot when the user inserts his or her foot part into the foot massage portion 500.

The sole airbags 504 are positioned at a lower side of the foot massage portion 500 and may massage the acupuncture points "yong cheon" and "sil myeon" through air injection.

In addition, the foot massage portion 500 may further include a sole massage ball 506 mounted at a lower side. The sole massage ball 506 may massage the acupuncture points "yong cheon" and "sil myeon" by imparting the rolling stimulus.

(5) Description of Protrusions 410 Formed on Airbags 204, 312, 402, 404, 406, 502, and 504

Figure 10:
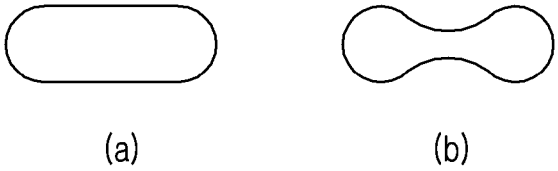
FIG. 10 is a view showing shapes of protrusions for massaging the acupuncture point according to an embodiment of the present invention.
Figure 11:
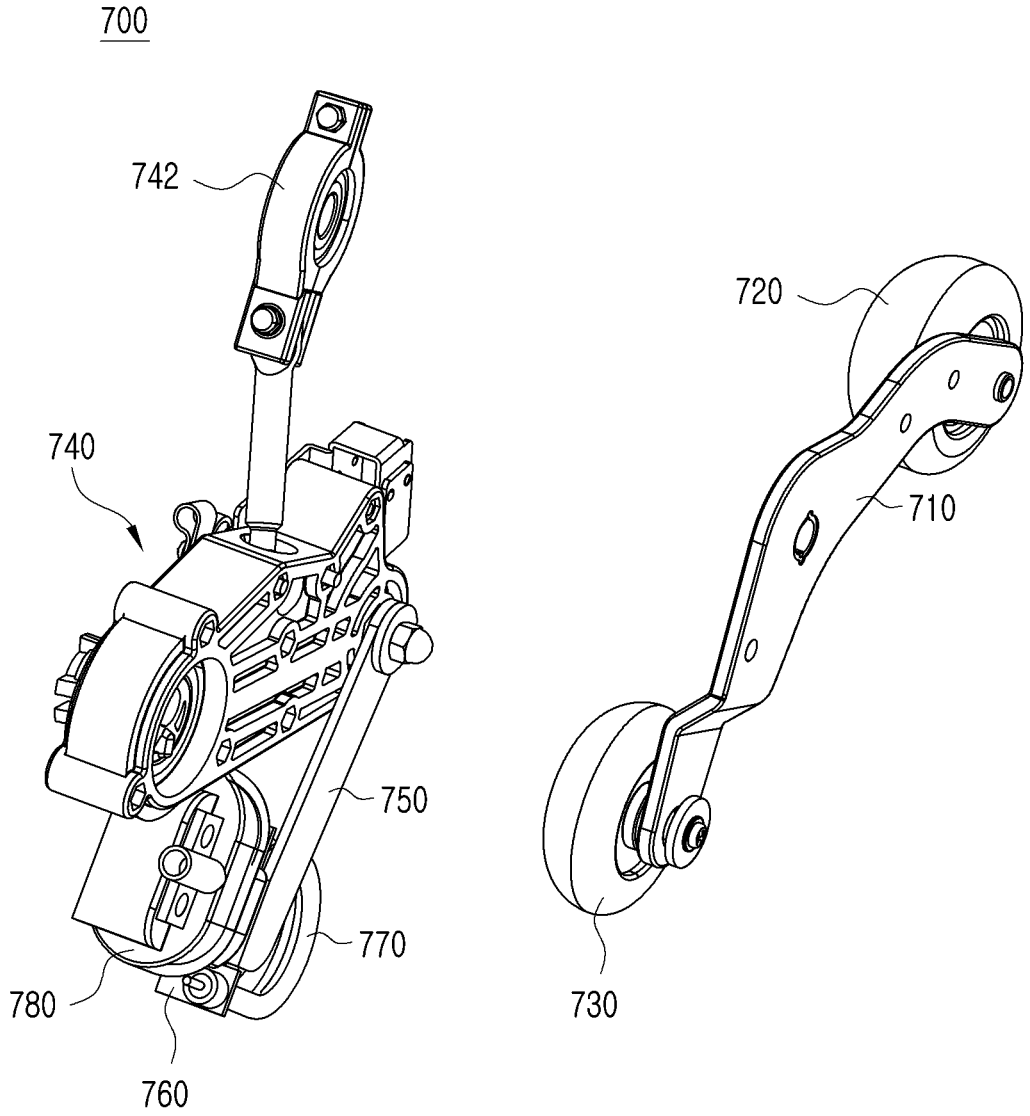
FIG. 11 is an exploded perspective view of a massage ball assembly for massaging the acupuncture points according to an embodiment of the present invention.
Figure 12:
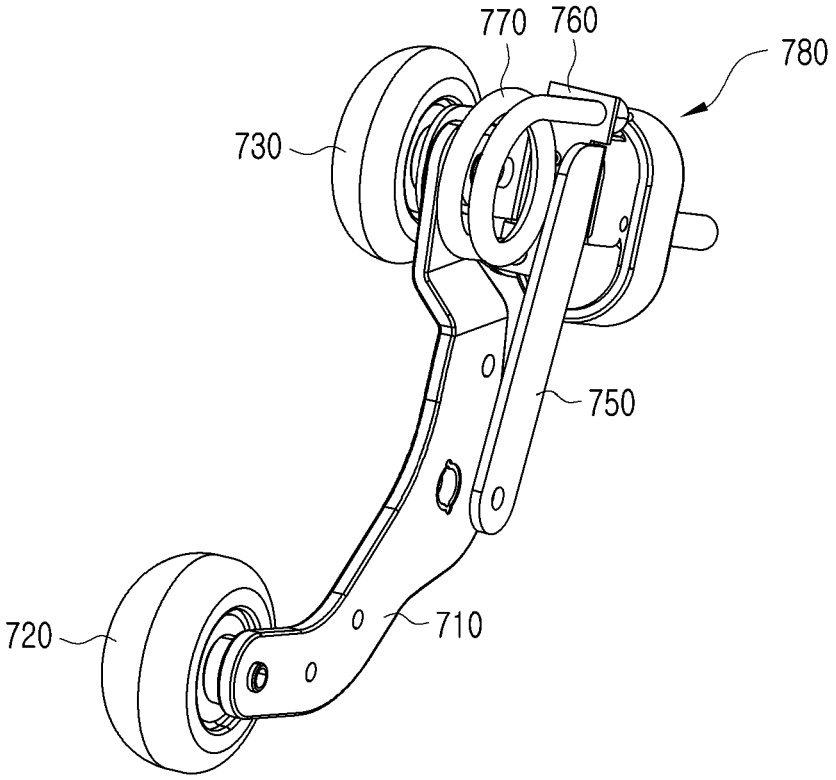
FIG. 12 is a perspective view of the massage ball assembly of FIG. 11.
Figure 13:
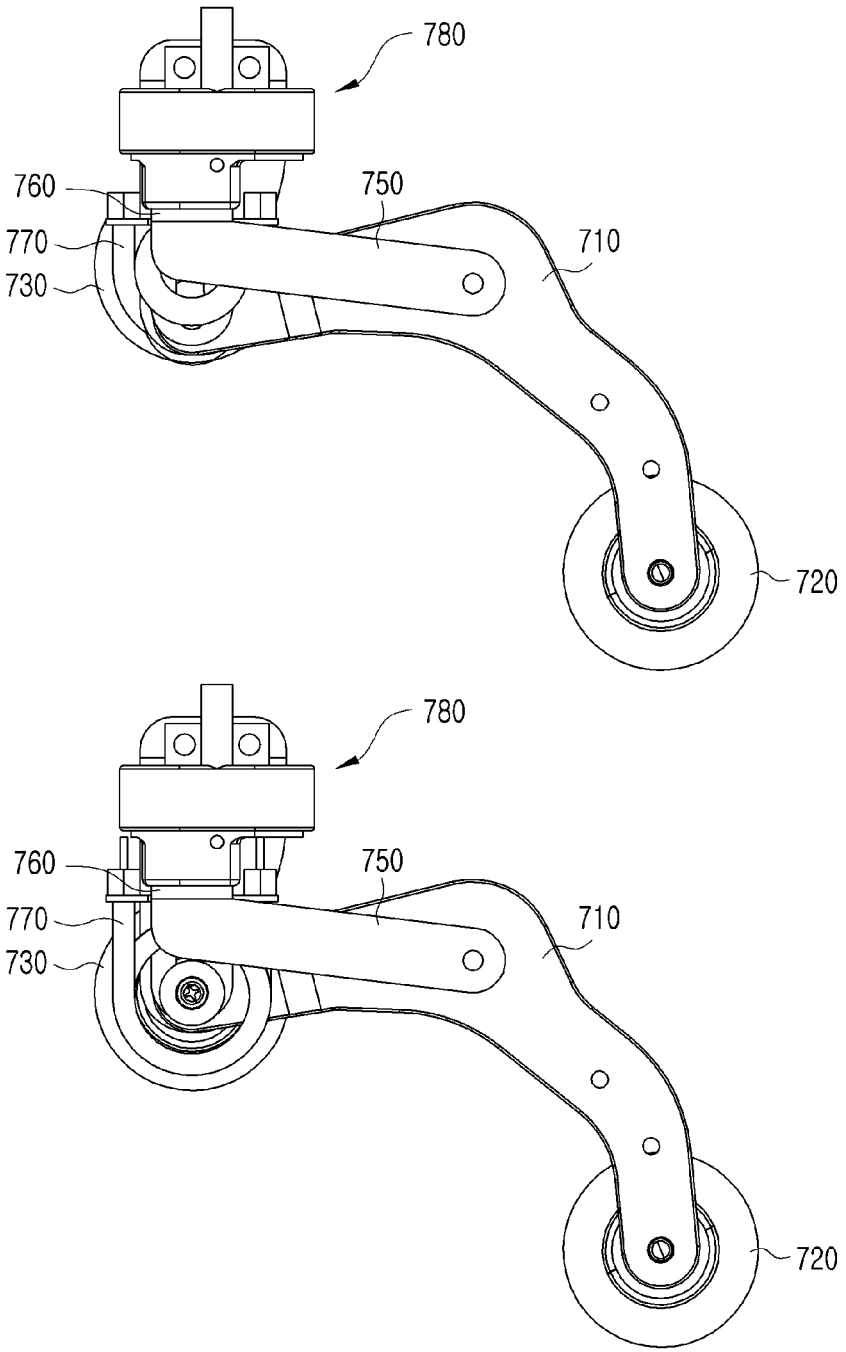
FIG. 13 is a side view of the massage ball assembly of FIG. 11.
Figure 14:
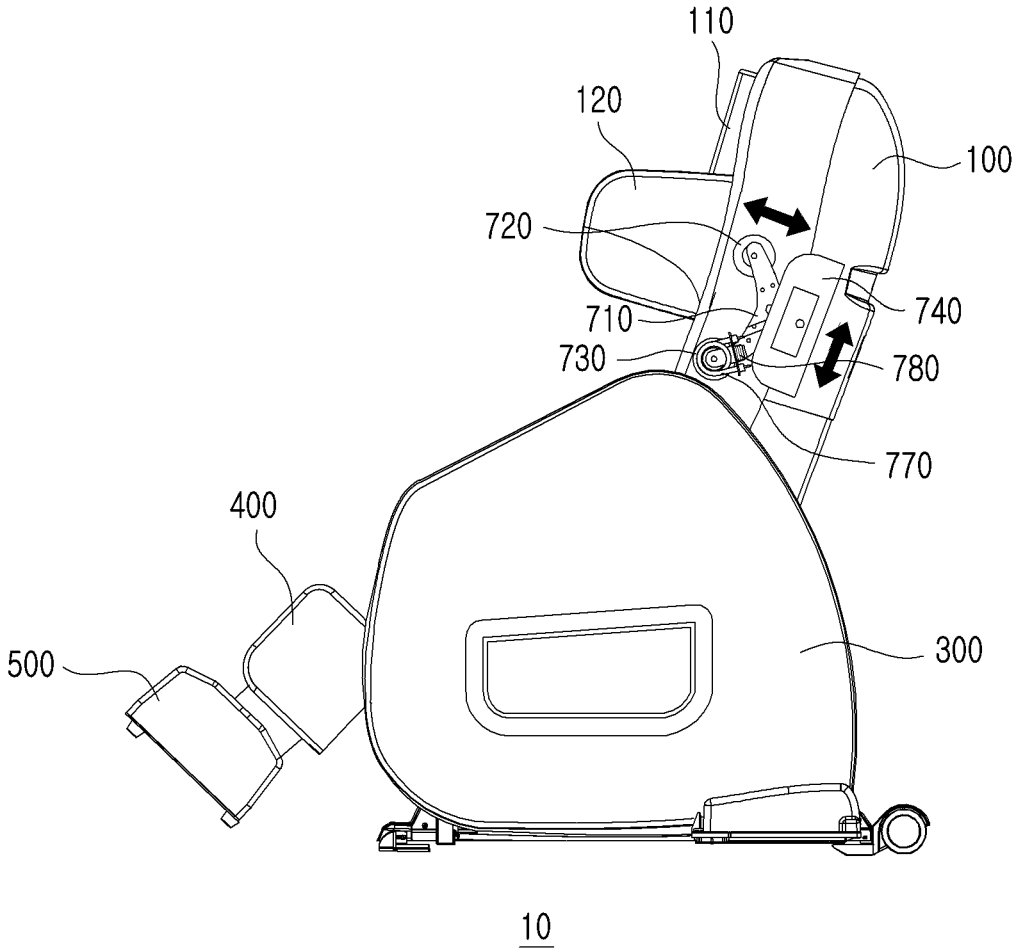
FIG. 14 is a view showing a state in which the massage ball assembly of FIG. 11 is mounted and operated in the massage chair.

Referring to FIG. 10, protrusions 410 may be formed on outer or inner sides of the airbags 204, 312, 402, 404, 406, 502, and 504 capable of acupuncture point massage.

The protrusions 410 are formed in a cylindrical shape and a dumbbell shape, but not limited thereto, and may have various other shapes capable of stimulating an acupuncture point. In addition, the protrusions 410 are formed of a hard or soft material.

The number, shape, material, and the like of the protrusions 410 formed on each of the airbags 204, 312, 402, 404, 406, 502, and 504 may be changed in accordance with the characteristics of the acupuncture point to be massaged by the protrusions 410.

As an example, hard cylindrical protrusions 410 may be disposed horizontally in the outer calf airbags 402, soft dumbbell-shaped protrusions 410 may be disposed horizontally in the inner calf airbags 404, and soft cylindrical or dumbbell-shaped protrusions 410 may be disposed horizontally in the rear calf airbags 406.

As another example, soft cylindrical protrusions 410 may be horizontally disposed in the instep airbags 502*b*, and each of the protrusions 410 may be inclined to form a predetermined angle with the ground. As an example, each of the protrusions 410 may be formed at an angle of 20 to 25 degrees with the ground.

5. Description of Massage Ball Assembly 700

Referring to FIG. 7, the massage chair 10 according to the present invention includes a massage ball assembly 700 for massaging the acupuncture point located in the vicinity of the vertebral bone.

One of the features that distinguishes the massage ball assembly 700 according to the embodiment of the present invention from the related art is that an upper massage ball 720, a lower massage ball 730, and a heating element 770 may perform the acupuncture point massage, respectively, in accordance with the acupuncture point, and the lower massage ball 730 and the heating element 770 may be moved in a straight line to massage the exact location of the acupuncture point.

Specifically, as described above, the acupuncture points located around T1 to L5 are massaged by mainly using acupressure that massage the acupuncture points and a narrow area therearound. However, in the related massage ball assembly, since the massage ball rotates about an axis to contact the body and perform massage, there is a concern that massage is performed at a location that is vertically deviated away from the location of the measured acupuncture point.

The massage ball assembly 700 according to an embodiment of the present invention may accurately perform the massage at the predicted acupuncture points by, rather than rotational movement about the axis, linearly moving the lower massage ball 730 and the heating element 770 in a direction toward and opposite to the back support portion 100 by the operation of a driver 780.

Hereinafter, the massage ball assembly 700 will be described in detail with reference to FIGS. 11 to 14.

(1) Description of Configuration of Massage Ball Assembly 700

In the illustrated embodiment, the massage ball assembly 700 includes a first bracket 710, an upper massage ball 720, a lower massage ball 730, a massage bundle 740, a second bracket 750, a support 760, a heating element 770, and a driver 780.

The upper massage ball 720 and the lower massage ball 730 are rotatably mounted at the first bracket 710. The first bracket 710 is rotatably mounted on the massage bundle 740 and may be moved together with the massage bundle 740 moving up and down or left and right, and thus the upper massage ball 720 and the lower massage ball 730 may also be moved together therewith.

In addition, it is possible to select the massage balls 720 and 730 to be in contact with the back part of the user, by the rotation of the first bracket 710. That is, it is possible to perform massage by only the upper massage ball 720 or perform massage by only the lower massage ball 730, and also possible to perform massage by only the heating element 770.

The upper massage ball 720 is rotatably mounted at one end of the first bracket 710. The upper massage ball 720 may be moved together with the first bracket 710 and may provide the massage stimulus to the user. In addition, the upper massage ball 720 may be rotated while being in contact with the body of the user, thereby providing the rolling stimulus to the user.

The lower massage ball 730 is rotatably mounted to the other end of the first bracket 710. The lower massage ball 730 may be moved together with the first bracket 710 and may provide the massage stimulus to the user. In addition, the lower massage ball 730 may be rotated while being in contact with the body of the user, thereby providing the rolling stimulus to the user.

The material of the upper massage ball 720 and the lower massage ball 730 may be any material that may provide an optimal massage feeling to the user and minimize noise during rotation.

The massage bundle 740 provides the power allowing the massage ball assembly 700 to perform one or more of vertical movement or left and right movement. The massage bundle 740 is provided with an actuator 742 for powering the massage ball assembly 700.

In addition, the massage bundle 740 provides the power supplied from the power supply (not shown) to the heating element 770 and the driver 780 to be described below through an individual wire (not shown) provided in the first bracket 710 and the second bracket 750.

The massage bundle 740 may be moved in various forms. The up-and-down movement and left-and-right movement as well as the rotational movement is possible, and the kneading movement for kneading operation and the tapping movement for the instantaneous compression are also possible.

That is, the massage ball assembly 700 according to the embodiment of the present invention may perform all of the acupressure, palm-pressure, compression, rubbing, kneading, rolling, instantaneous massage, and the like described above.

The massage bundle 740 is rotatably mounted to the first bracket 710 and the second bracket 750.

The second bracket 750 is rotatably mounted to the massage bundle 740 and is connected to the support 760 to be described below. By the second bracket 750, the movement of the lower massage ball 730 and the heating element 770 may be restricted to linear movements, that excludes rotational movements.

Specifically, generally, the first bracket 710 is rotatably mounted to the massage bundle 740 so that the upper massage ball 720 and the lower massage ball 730 are moved according to the movement of the massage bundle 740, or the first bracket 710 is rotated about an axis connected to the massage bundle 740, thereby performing the massage.

The driver 780, which will be described below, may be fixed to the massage ball assembly 700 according to an embodiment of the present invention by the second bracket 750. Therefore, by the operation of the driver 780, the lower massage ball 730 or the heating element 770 may be linearly moved in a direction toward and opposite to the back support portion 100, thereby performing accurate massage on the predicted acupuncture points.

The driver 780 (to be described) is connected to one side of the support 760. In addition, the lower massage ball 730 and the heating element 770 are located on the other side of the support 760 to face the driver 780.

The heating element 770 provides a feeling of warmth to the user through heat generation. In addition, the heating element 770 may impart the compression stimulus to the user by using both the heat and the compression together. Therefore, the user may be provided with an effect same as the moxibustion acupressure on a specific desired part.

The driver 780 provides power for the lower massage ball 730 and the heating element 770 to move linearly.

In the illustrated embodiment, the driver 780 may be provided as a motor. When the motor is driven, the lower massage ball 730 and the heating element 770 may be linearly moved toward the user to compress the desired part, without requiring a movement of the first bracket 710. More specifically, the motor may perform a kneading operation and move the lower massage ball 730 and the heating element 770 up and down.

In another embodiment, the driver 780 may be provided as an airbag. When air is injected into the airbag, the lower massage ball 730 and the heating element 770 may be linearly moved toward the user to compress the desired part, without requiring a movement of the first bracket 710.

Alternatively, a plurality of motors may be provided, and these may be classified into a kneading motor capable of performing a kneading operation, and a moving motor capable of moving the lower massage ball 730 and the heating element 770, respectively.

For operation of the driver 780, a wire (not shown) for supplying power to the motor, or an air injection means (not shown) for injecting air into the airbag may be provided.

(2) Description of Acupuncture Point Massage Process by Massage Ball Assembly 700

The massage ball assembly 700 may massage the acupuncture points located in the vicinity of the vertebral bones by the upper massage ball 720 and the lower massage ball 730 (see FIG. 4). Hereinafter, the process of performing acupuncture point massage based on the location of the vertebral bones will be described.

1) Description of Process of Performing Acupuncture Point Massage by Upper Massage Ball 720

First, C1 to C7, that is, the acupuncture points of the cervical spine part are preferably massaged by the upper massage ball 720. In order to perform massage by the lower massage ball 730, the first bracket 710 need to be rotated so that the lower massage ball 730 may contact the C1 to C7 parts.

This is because, in this case, the upper massage ball 720 is raised higher than the C1 part by the rotation of the first bracket 710, making it difficult to implement due to the structure of the massage ball assembly 700.

As described above, massage may be performed by mainly using the kneading or rubbing with respect to the acupuncture points located around C1 to C7, and accordingly, it is preferable that massage is performed with respect to not only the location of acupuncture point, but also the area around the acupuncture point, rather than performing the massage with respect to only the exact location of the acupuncture point.

Therefore, the upper massage ball 720 is rotatably moved by the rotation of the first bracket 710 to massage the acupuncture points "an myeon", "pung bu", "cheon ju", "pung ji", "gyeon jeong" and "gyeon jung su", and the areas around each acupuncture point.

Of course, before the upper massage ball 720 massages the acupuncture point, the upper massage ball 720 may be moved by the movement of the massage bundle 740 to match the respective acupuncture points.

2) Description of Process of Performing Acupuncture Point Massage by Lower Massage Ball 730

Acupuncture points T1 to L5, that is, the acupuncture points at the thoracic vertebra, lumbar vertebrae, and sacrum bone are preferably massaged by the lower massage ball 730. This is because, when massage is performed by the upper massage ball 720, by structure, interference may occur in adjusting the width of the line 2 of the "bang gwang gyeong", among the line 1 of "bang gwang gyeong" and line 2 of "bang gwang gyeong", which is at about 180 mm location.

As described above, since massage may be performed by mainly using the acupressure on the acupuncture points located around T1 to L5, massage may be preferably performed at the exact location of the acupuncture points.

Accordingly, the lower massage ball 730 is linearly moved by the driver 780, so that the acupuncture points "gyeon oe su", "ji su", "sim su", "yeong dae", "dok su", "ui hoe", "gyeok su", "gyeok gwan", "ji yang", "hon mun", "gan su", "dam su", "yang gang", "bi su", "ui sa", "wi su", "wi chang", "sam cho su", "sim su", "ji sil", "myeong mun", "gi hae su", "dae jang su", "gwan won su", "so jang su", "bang gwang su", "sang nyo", "mi gol dan" and "cha ryo" are massaged.

Alternatively, the heating element 770 located adjacent to the lower massage ball 730 may be linearly moved together to deliver the feeling of warmth and the massage at the same time, or only the heating element 770 alone may be linearly moved to massage and deliver the feeling of warmth.

Of course, before the lower massage ball 730 or the heating element 770 massages the acupuncture point, the lower massage ball 730 or the heating element 770 may be moved by the movement of the massage bundle 740 to correspond the respective acupuncture points.

7. Description of Acupuncture Point Massage Process Through Manipulation Portion 600

According to an embodiment of the present invention, when the user is seated on the massage chair 10, the massage chair 10 primarily detects a shoulder location and predicts a location of the hip bone based on such detection, and then predicts the location of the acupuncture point based on the predicted location of the hip bone to perform the massage.

In addition, the accuracy of the location prediction of the acupuncture point may be improved by further inputting the information of the user such as heights, and so on, and correcting the predicted location of the acupuncture point based on the same.

To this end, the manipulation portion 600 includes a shoulder height measurement module 610, a hip bone location prediction module 620, a massage location determination module 630, a massage mode selection module 640, a user information input module 650, a body mass index (BMI) calculation module 660, a massage intensity setting module 670, and a hip bone location correction module 680.

Figure 15:
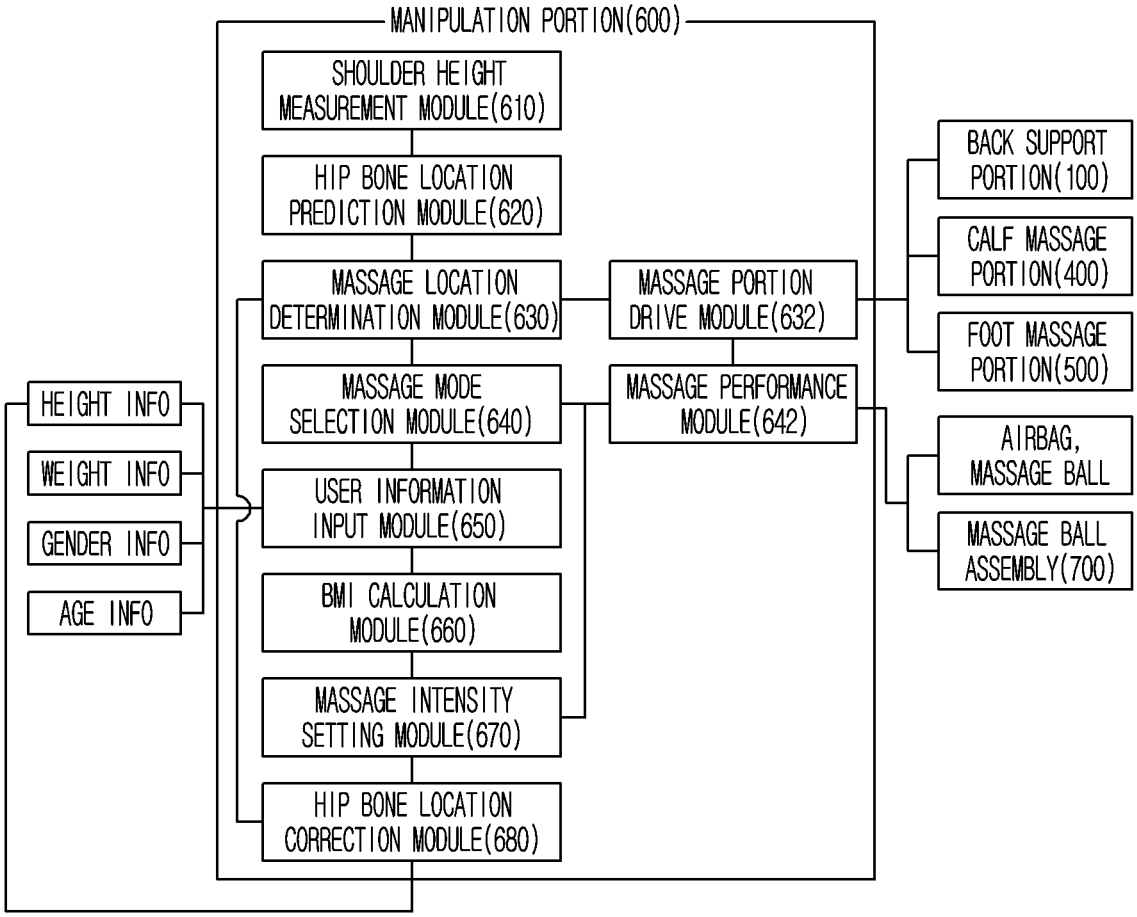
FIG. 15 is a block diagram showing a configuration for massaging acupuncture points according to an embodiment of the present invention.
Figure 16:
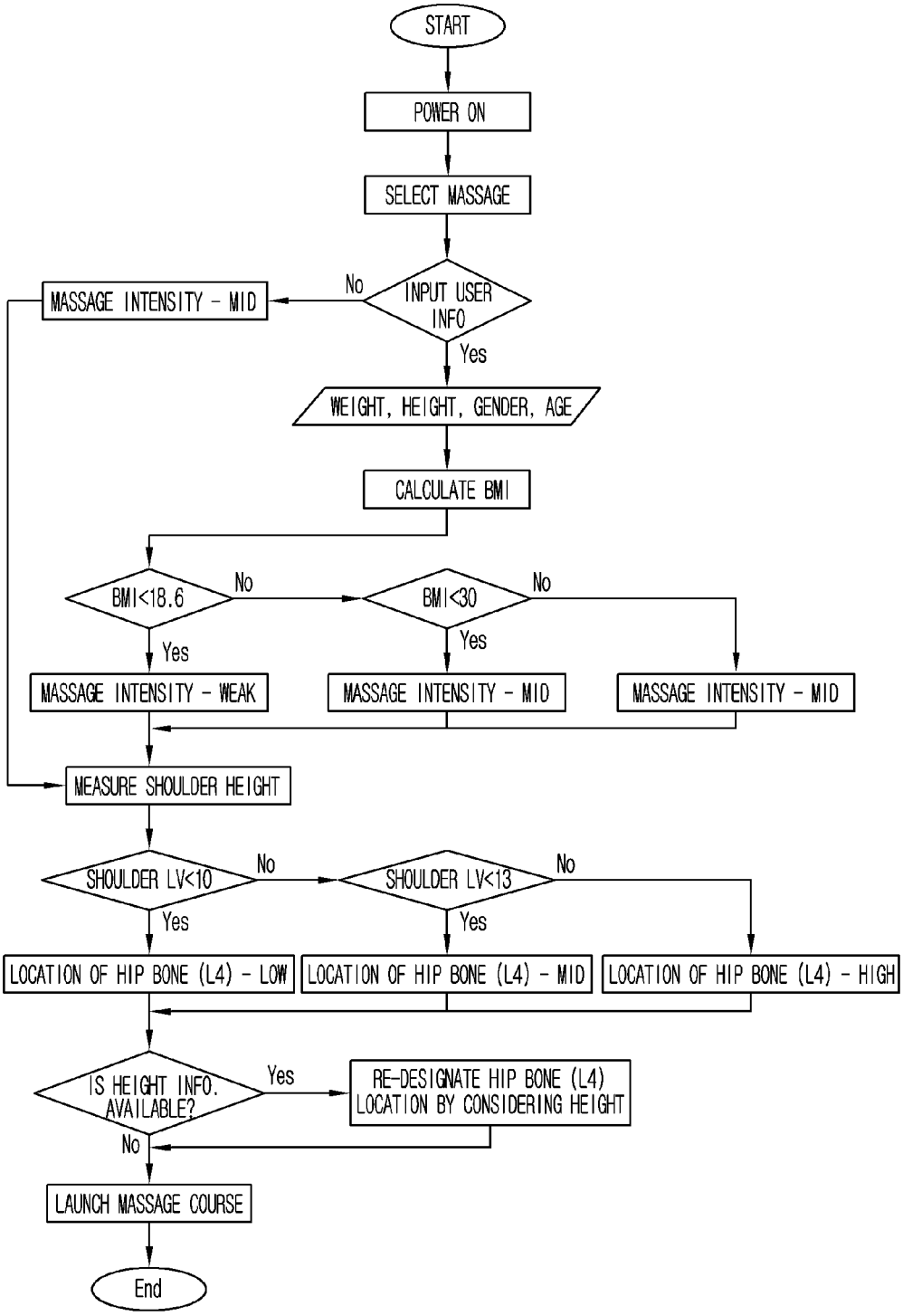
FIG. 16 is a flowchart showing a process of massaging acupuncture points according to an embodiment of the present invention.
Figure 17:
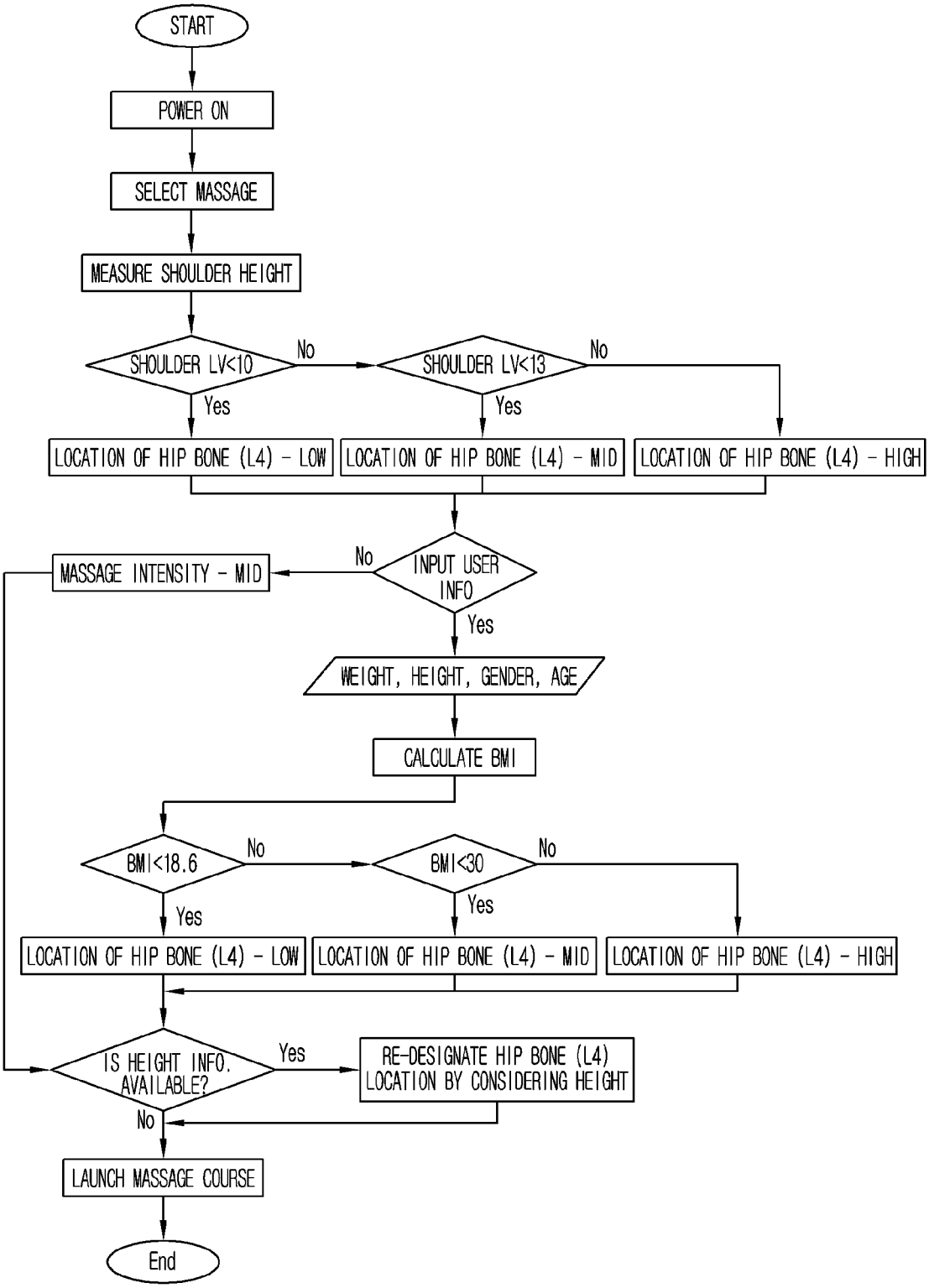
FIG. 17 is a flowchart showing a process of massaging acupuncture point according to another embodiment of the present invention.

Hereinafter, the process of the massage chair 10 according to an embodiment of the present invention for predicting the location of the acupuncture point of the user and performing massage will be described in detail with reference to FIGS. 15 to 17.

(1) Description of Process of Measuring Shoulder Height of User by Shoulder Height Measurement Module 610

When the user is seated in the massage chair 10, the shoulder height measurement module 610 measures the shoulder height of the user. To this end, the massage chair 10 may include a shoulder location detecting means (not shown).

The reason for detecting the shoulder location is to predict the location of the hip bone to be described below, and this is based on the fact that the location of the acupuncture point distributed in the body part of a person can be set based on the location of the hip bone.

At this time, the location of the hip bone is in proportion to the height, and the shoulder location is also in proportion to the height. Accordingly, the location of the hip bone may be predicted by measuring the shoulder location.

(2) Description of Process of Hip Bone Location Prediction Module 620 for Predicting Hip Bone Location As described above, the hip bone location prediction module 620 predicts the location of the hip bone using the shoulder height of the user measured by the shoulder height measurement module 610. To this end, a body information database (not shown) for storing big data mapping correlations between the height of person, the location of the hip bone, and the location of shoulder may be further included.

More specifically, the hip bone location prediction module 620 classifies the previously-measured shoulder locations of the user in accordance with height in order to predict the location of the hip bone. As an example, the shoulder height may be classified into 19 levels from Levels 1 to 19.

At this time, the lowest shoulder height may be classified into Level 1, and the highest shoulder height may be classified into Level 19.

When the measured shoulder height is classified into specific level, the hip bone location prediction module 620 compares the measured shoulder height level with a predetermined first shoulder height value and a predetermined second shoulder height value.

At this time, the first shoulder height value is set to be less than the second shoulder height value. That is, the shoulder height measured by the first shoulder height value and the second shoulder height value may be classified into any one of three groups. As an example, the first shoulder height value may be determined to be Level 10, and the second shoulder height value may be determined to Level 13.

When the measured shoulder height is less than the first shoulder height value, the hip bone location prediction module 620 predicts the location of the hip bone to be a predetermined first hip bone location value. As an example, the first hip bone location value may be 'low'.

When the measured shoulder height is equal to or greater than the first shoulder height value and less than a second shoulder height value, the hip bone location prediction module 620 predicts the location of the hip bone to be a predetermined second hip bone location value. As an example, the second hip bone location value may be 'middle'.

When the measured shoulder height is equal to or greater than the second shoulder height value, the hip bone location prediction module 620 predicts the location of the hip bone to be a predetermined third hip bone location value. As an example, the third hip bone location value may be 'high'.

(3) Description of Process of Massage Location Determination Module 630 for Determining a Plurality of Massage Locations When the location of the hip bone is predicted, the massage location determination module 630 determines a plurality of massage locations based on the predicted location of the hip bone. In an embodiment of the present invention, the plurality of massage locations may be the locations of the acupuncture points.

As described above, the location of the hip bone is closely related to the locations of the acupuncture points distributed in the body. To determine the massage location, the massage location determination module 630 may further include an acupuncture point location database (not shown) mapping and storing therein correlations between the locations of the hip bone and the locations of the acupuncture point distributed in the body.

When the massage location determination module 630 determines a plurality of massage locations, the massage portion drive module 632 moves any one of the back support portion 100, the calf massage portion 400, and the foot massage portion 500.

That is, the massage portion drive module 632 adjusts the location of one or more of the back support portion 100, the calf massage portion 400 and the foot massage portion 500 in accordance with the location of the body of the user seated on the massage chair 10, so that the airbags 102, 122, 202, 204, 312, 402, 404, 406, 502, and 504, the massage balls 408, 506, and the massage ball assembly 700 can perform massage at a plurality of determined massage locations.

(4) Description of Process of Massage Mode Selection Module 640 for Selecting Massage Mode When a plurality of massage locations is determined, the massage mode selection module 640 selects a massage mode to massage the determined plurality of massage locations. There may be various massage modes that may be selected, which will be described below.

Alternatively, the massage mode selection module 640 may output a selectable massage mode to an output unit (not shown) of the manipulation portion 600 to allow a user to input a desired separate massage mode.

Alternatively, the massage mode selection module 640 may select a massage mode input by the user through the manipulation portion 600 without selecting the massage mode.

When the massage mode selection module 640 selects a massage mode, the massage performance module 642 controls the airbags 102, 122, 202, 204, 312, 402, 404, 406, 502, and 504, the massage balls 408, 506, and the massage ball assembly 700 to massage the plurality of determined massage locations in accordance with the selected massage mode.

As a result, the airbags 102, 122, 202, 204, 312, 402, 404, 406, 502, and 504, the massage balls 408, 506, and the massage ball assembly 700 massage the plurality of determined massage locations in accordance with the selected massage mode.

(5) Description of Process of User Information Input Module 650 for Receiving User Information The user may input his or her gender information, age information, height information, and weight information through the manipulation portion 600. More specifically, the user information is input through the user information input module 650.

At this time, the user may select user information to be input by the user himself or herself. That is, one or more of gender information, age information, height information, and weight information may be input.

However, as will be described below, it is preferable that the height information is necessarily input for correcting the location of the hip bone.

In addition, as will be described below, it is preferable that the weight information is also necessarily input for calculating the BMI value.

The user information input by the user information input module 650 is utilized for setting intensity of massage and correcting the hip bone location.

(6) Description of Process of BMI Calculation Module 660 for Calculating BMI When both the height information and the weight information are input to the user information input module 650, the BMI calculation module 660 calculates the BMI using the input user information.

Since calculating the BMI is a well-known process, a detailed description thereof will be omitted.

(7) Description of Process of Massage Intensity Setting Module 670 for Setting Intensity of Massage When the BMI is calculated, the massage intensity setting module 670 sets the intensity of massage using the calculated BMI.

Specifically, when the user has a high BMI, it indicates a high possibility of obese body type, and accordingly, the intensity of massage may be required to be strong enough for the user to feel the massage. In addition, some users may not feel pain even with a strong intensity massage.

Specifically, when the user has a low BMI, it indicates a high possibility of slim body type, and accordingly, the intensity of massage may be preferably weak in consideration of the possibility that the user would feel pain.

Accordingly, the massage intensity setting module 670 compares the calculated BMI with predetermined first and second BMI values. At this time, since the BMI indices may be expressed numerically, they may be classified into groups through comparison without requiring a separate level setting process.

At this time, the first BMI value is set less than the second BMI value. That is, the BMI calculated by the first BMI value and the second BMI value may be classified into any one of three groups. As an example, the first BMI value may be set to 18.5 and the second BMI value may be set to 30.

When the calculated BMI is less than the first BMI value, the massage intensity setting module 670 sets the intensity of massage to a predetermined first value. As an example, the first value may be 'weak intensity of massage'.

When the calculated BMI is equal to or greater than the first BMI value and less than the second BMI value, the massage intensity setting module 670 sets the intensity of massage to a predetermined second value. As an example, the second value may be 'middle intensity of massage'.

When the calculated BMI is equal to or greater than the second BMI value, the massage intensity setting module 670 sets the intensity of massage to a predetermined third value. As an example, the third value may be 'strong intensity of massage'.

When the massage intensity setting module 670 sets the intensity of massage, the massage performance module 642 controls the airbags 102, 122, 202, 204, 312, 402, 404, 406, 502, and 504, the massage balls 408, 506, and the massage ball assembly 700 to massage the plurality of determined massage locations in accordance with the set intensity of massage.

As a result, the airbags 102, 122, 202, 204, 312, 402, 404, 406, 502, and 504, the massage balls 408, 506, and the massage ball assembly 700 massage the plurality of determined massage locations in accordance with the set intensity of massage.

(8) Description of Process of Hip Bone Location Correction Module 680 for Correcting Location of Hip Bone As described above, the user information input module 650 may receive the height information of the user. In addition, the location of the hip bone may be in proportion to the height.

The hip bone location correction module 680 corrects the location of the hip bone predicted by the hip bone location prediction module 620 using the height information of the user. To this end, the hip bone location correction module 680 may further include a body information database (not shown).

When the hip bone location correction module 680 corrects the location of the hip bone, the massage location determination module 630 re-determines a plurality of massage locations based on the corrected location of the hip bone.

When the massage location determination module 630 determines a plurality of massage locations, the massage portion drive module 632 moves any one of the back support portion 100, the calf massage portion 400, and the foot massage portion 500.

That is, the massage portion drive module 632 adjusts the location of one or more of the back support portion 100, the calf massage portion 400 and the foot massage portion 500 in accordance with the location of the body of the user seated on the massage chair 10, so that the airbags 102, 122, 202, 204, 312, 402, 404, 406, 502, and 504, the massage balls 408, 506, and the massage ball assembly 700 can perform massage at a plurality of determined massage locations.

When a plurality of massage locations is determined, the massage mode selection module 640 selects a massage mode to massage the determined plurality of massage locations.

When the massage mode selection module 640 selects a massage mode, the massage performance module 642 controls the airbags 102, 122, 202, 204, 312, 402, 404, 406, 502, and 504, the massage balls 408, 506, and the massage ball assembly 700 to massage the plurality of determined massage locations in accordance with the selected massage mode.

As a result, the airbags 102, 122, 202, 204, 312, 402, 404, 406, 502, and 504, the massage balls 408, 506, and the massage ball assembly 700 massage the plurality of determined massage locations in accordance with the selected massage mode.

8. Description of Each Massage Mode

Hereinafter, a plurality of massage modes that may be performed by the massage chair 10 according to an embodiment of the present invention will be described. The plurality of pre-stored massage modes may be selected by the massage mode selection module 640 or may be selected by a user.

(1) Description of Hae-Ul-Cheong-Sim(Hae-Ul)Mode

Hae-Ul-Cheong-Sim (or Hae-Ul) mode has the effect of relieving stress and relaxing the tension by reducing the pent-up pressure and wrath of the Gan Gi (or liver energy).

For this purpose, in the Hae-Ul-Cheong-Sim mode, one or more of the acupuncture points "tae chung", "sam eum gyo", "chuk bin" and "eum gok" (lower limb portion), "gyeok su", "gan su", "sim su", "pye su", "baek ho", "go hwang", and "sin dang" (torso portion), "gyeon jeong" and "pung ji" (neck portion), and "no gung", "so bu", "sin mun", "nae gwan" and "su sam ni" (upper limb portion) are massaged.

Preferably, massage may be performed in the order of lower limb ("tae chung", "sam eum gyo", "chuk bin", "eum gok"), torso portion ("gyeok su", "gan su", "sim su", "pye su", "baek ho", "go hwang", "sin dang"), neck portion ("gyeon jeong", "pung ji"), upper limb ("no gung", "so bu", "sin mun", "nae gwan", "su sam ni"), lower limb ("tae chung", "sam eum gyo", "chuk bin", "eum gok"), torso portion, neck portion ("gyeon jeong", "pung ji"), and upper limb ("no gung", "so bu", "sin mun", "nae gwan", "su sam ni").

The effects of each acupuncture point massage are as follows.

Massaging the "tae chung" (liver meridian) can release the stagnation of the liver energy with the acupuncture points and energy sources of the liver meridian. As a result, symptoms such as indigestion, lower limb pain, or headache may be improved.

Massaging the "sam eum gyo" (spleen meridian) can protect the spleen, help digestion, release the stagnation of the energy, loosen the tension of the "ha cho", normalize the functioning of the uterus and ovaries and testicles, and treat pain in the lower body. As a result, symptoms such as anorexia, indigestion, nervous breakdown, urogenital diseases, or cold hands and feet may be improved.

Massaging the "chuk bin" (kidney meridian) can treat the urogenital diseases and mental disorders. As a result, symptoms such as mental disorders, urogenital diseases, or lower limb muscle pain may be improved.

Massaging the "eum gok" (kidney meridian) can remove stagnant moisture, allow urine to pass through, and restore from the abnormal flow of vital energy. As a result, symptoms such as urination disorder, digestive disorder, or reproductive troubles may be improved.

Massaging the "gyeok su" (bladder meridian) can relieve chest congestion, balance the energy of the stomach, clear the blood fever, and help recover from the weak health. As a result, acid indigestion, esophageal stricture, neurosis, palpitations, diaphragm spasm, bronchitis, chest pain, angina pectoris, or spinal pain may be improved.

Massaging the "gan su" (bladder meridian) can strengthen spirits, release the stagnation of energy, and refresh the mind. As a result, symptoms such as hysteria, intercostal neuralgia, neurosis, back and spinal pain, insomnia, dizziness, eye pain, liver or gallbladder disease may be improved.

Massaging the "sim su" (bladder meridian) can strengthen and stabilize spirits, refresh the mind, relaxes the mind, and regulate the circulation of blood and energy. As a result, symptoms such as palpitations, angina pectoris, elevation of blood pressure, nervous breakdown, headache, neurosis, or forgetfulness may be improved.

Massaging the "pye su" (bladder meridian) can regulate the lung energy, compensate for consumption, clear consumptive fever, and balance spirits. As a result, symptoms such as chronic cough, asthma, vomiting, shoulder and back pain or cold sweat may be improved.

Massaging the "baek ho" (bladder meridian) can allow the energy of lungs to be stretched out and through, calm asthma, or stop coughing. As a result, symptoms such as chronic cough, asthma, shoulder and back pain, or neck stiffness may be improved.

Massaging the "go hwang" (bladder meridian) can strengthen the lungs, make the spleen healthy, reinforce weak health, relax the heart, or strengthen the kidneys. As a result, symptoms such as respiratory disease, heart disease, neurosis, acid indigestion, forgetfulness, or shoulder and back pain may be improved.

Massaging the "sin dang" (bladder meridian) can relax chest, manage energy, or relax heart. As a result, symptoms such as heart disease, neurosis, mental disorders, asthma, or chronic cough may be improved.

Massaging the "gyeon jeong" (gallbladder meridian) can facilitate the flow along the meridian, normalize function, remove the putum, and refresh the mind. As a result, symptoms such as nausea, headache, vertigo, neck pain, or shoulder and back pain may be improved.

Massaging the "pung ji" (gallbladder meridian) can remove wind-evil, remove surface-evil by sweating, reduce fever, and allow smooth joints. As a result, symptoms such as headache, rhinitis, sinusitis, neck pain, back pain, back ache, hypertension, or insomnia may be improved.

Massaging the "no gung" (pericardium meridian) can calm wrath, remove damp heat, suppress cramps, reduce blood fever, stabilize the mind, and normalize the stomach function. As a result, symptoms such as palsy, fatigue, chronic cough, neurosis, dysphagia, or vomiting may be improved.

Massaging the "so bu" (heart meridian) can stabilize the mind, regulate the spirits, and clear away the fever in the body. As a result, symptoms such as chest pain, pectoralgia, mental instability, neurosis, palpitations, arrhythmia, heart disease, facial flushing, fever, or thermalgia may be improved.

Massaging the "sin mun" (heart meridian) can stabilize the mind, calm anger force, cool down the spirits, clear away the anger fever, and regulate the upward rush of energy. As a result, symptoms such as heart disease, neurosis, psychosis, palpitations, insomnia, and asthma may be improved.

Massaging the "nae gwan" (pericardium meridian) can clean the "po lak", facilitate the flow of energy of "sam cho", stabilize the mind, normalize the stomach function, relax the chest, and facilitate the flow of energy. As a result, symptoms such as hypertension, anxiety, palpitations, nausea, vomiting, gastritis, or chest pain may be improved.

Massaging the "su sam ni" (large intestine meridian) can remove wind-evil, facilitate the flow through meridians, and improve the function of the stomach and intestines. As a result, symptoms such as palsy-hemiplegia, diarrhea, blush, rhinitis, shoulder pain, indigestion, stomach pain, or lumbar pain may be improved.

(2) Description of Ahn-Shin-Do-Myeon (Ahn-Myeon) Mode

Ahn-Shin-Do-Myeon (or Ahn-Myeon) mode is an acupressure and acupuncture massage mode for mind and body rest and sleep disorder improvement. According to meridian theory of oriental medicine, when it comes to sleep physiology, the meridian physiology of Yang Heel (Vessel) meridian and Yin Heel (Vessel) meridian plays an important role. The Yang Heel (Vessel) meridian and Yin Heel (Vessel) meridian run from the lower limb portion to the head, so the Ahn-Shin-Do-Myeon mode that stabilizes the mind and improves sleep disorders may start from the lower limb portion.

To this end, in the Ahn-Shin-Do-Myeon mode, one or more of the acupuncture points "an myeon hyeol", "pung ji" and "jin jeong" (head and neck portion), "nae gwan" and "so bu" (upper limb), "gyeon jeong", "sim su" and "bi su" (torso portion), "eum neung cheon", "sam eum gyo", "tae chung" and "sil myeon" (lower limb) are massaged.

Preferably, massage may be performed in the order of the lower limb, torso portion and sole, neck portion and sole, upper limb and sole, neck portion and sole, lower limb, upper limb and sole, and neck portion.

The effects of each acupuncture point massage are as follows.

Massaging the "an myeon hyeol" can stabilize the mind and improve sleep disorders. As a result, symptoms such as insomnia, neurosis, headache, or vertigo may be improved.

Massaging the "pung ji" (gallbladder meridian) can remove wind-evil, remove surface-evil by sweating, reduce fever, and allow smooth joints. As a result, symptoms such as headache, rhinitis, sinusitis, neck pain, back pain, back ache, hypertension, or insomnia may be improved.

Massaging the "nae gwan" (heart meridian) can clean the "po lak", facilitate the flow of energy of "sam cho", stabilize the mind, normalize the stomach function, relax the chest, and facilitate the flow of energy. As a result, symptoms such as hypertension, anxiety, palpitations, nausea, vomiting, gastritis, or chest pain may be improved.

Massaging the "no gung" (heart meridian) can stabilize the mind, regulate the spirits, and clear away the fever in the body. As a result, symptoms such as chest pain, pectoralgia, mental instability, neurosis, palpitations, arrhythmia, heart disease, facial flushing, fever, or thermalgia may be improved.

Massaging the "gyeon jeong" (gallbladder meridian) can facilitate the flow along the meridian, normalize function, remove the putum, and refresh the mind. As a result, symptoms such as nausea, headache, vertigo, neck pain, or shoulder and back pain may be improved.

Massaging the "sim su" (bladder meridian) can strengthen and stabilize spirits, refresh the mind, relaxes the mind, and regulate the circulation of blood and energy. As a result, symptoms such as palpitations, angina pectoris, elevation of blood pressure, nervous breakdown, headache, neurosis, or forgetfulness may be improved.

Massaging the "bi su" (bladder meridian) can help digestion, improve water metabolism, regulate energy, and balance spirits. As a result, symptoms such as gastritis, vomiting, stomach sickness and weakness, forgetfulness, flank pain, abdominal pain, edema, anemia, fatigue, or urticaria may be improved.

Massaging the "eum neung cheon" (spleen meridian) can operate the "jung cho", release the moist congestion, regulate the function of the bladder, and remove the wind chill. As a result, symptoms such as lower limb edema, lower limb pain, abdominal cold, digestive disorder, back pain, anorexia, or abdominal inflation may be improved.

Massaging the "sam eum gyo" (spleen meridian) can protect the spleen, help digestion, release the stagnation of the energy, loosen the tension of the "ha cho", normalize the functioning of the uterus and ovaries and testicles, and treat pain in the lower body. As a result, symptoms such as anorexia, indigestion, nervous breakdown, urogenital diseases, or cold hands and feet may be improved.

Massaging the "tae chung" (liver meridian) can release the stagnation of the liver energy with the acupuncture points and energy sources of the liver meridian. As a result, symptoms such as indigestion, lower limb pain, or headache may be improved.

Massaging the "sil myeon" can improve sleep. As a result, symptoms such as sleep disorders may be improved.

(3) Description of Seo Geun Je Tong-back Pain (Relaxation Psoas Muscle) Mode

The Seo Geun Je Tong-back pain (or relaxation psoas muscle) mode is an acupressure and acupuncture massage mode centered around the lumbar muscles, which is provided for the relaxation of the muscles of the spine and also for the improvement of the back pain. The "bang gwang gyeong" acupuncture points distributed in the lumbar muscles are mainly massaged, and acupuncture point such as "dae jang gyeong" and "dam gyeong" are supplementarily massaged.

To this end, in the Seo Geun Je Tong-back pain mode, one or more of the acupuncture points "eum neung cheon", "seung geun", "seung san" and "dae do" (lower limb), "sim su", "ji sil", "dae jang su", "gwan won su", "so jang su" and "gyeok su" (torso portion), "gong choe", "hap gok" and "su sam ni" (upper limb), and "gyeon jeong" and "pung ji" (head and neck portion) are massaged.

Preferably, massage may be performed in the order of the lower limb, torso portion, neck portion, torso portion, upper limb, head and neck portion, lower limb, torso portion, and lower limb.

The effects of each acupuncture point massage are as follows.

Massaging the "eum neung cheon" (spleen meridian) can operate the "jung cho", release the moist congestion, regulate the function of the bladder, and expel wind-dampness. As a result, symptoms such as lower limb edema, lower limb pain, abdominal cold, digestive disorder, back pain, anorexia, or abdominal inflation may be improved.

Massaging the "seung geun" (bladder meridian) can strengthen the waist and knees, and treat diseases of the anus. As a result, symptoms such as back pain, lower limb pain, lower limb edema, or hemorrhoids may be improved.

Massaging the "seung san" (bladder meridian) can relax muscles, reduce blood fever, improve bowel function, treat hemorrhoids, and improve the function of the six entrails. As a result, symptoms such as back pain, sciatica, lower limb pain, lower limb edema, or hemorrhoids may be improved.

Massaging the "dae do" (spleen meridian) can strengthen the spleen, improve digestion, restore Yang energy to restore from backward flow of energy ("gweol yeok"). As a result, symptoms such as back pain, indigestion, toe pain, disorder of menstruation, fever, constipation, or cold hand and feet syndrome may be improved.

Massaging the "sim su" (bladder meridian) can enhance energization function, improve water metabolism, enhance procreation internal secretion function, and strengthen lumbar and belly. As a result, symptoms such as back pain, hypogonadism, infertility, decreased vision, edema, headache, nervous breakdown, or anemia may be improved.

Massaging the "ji sil" (bladder meridian) can enhance renal function, replenish the vital force, help urinate well, and improve edema. As a result, symptoms such as back pain, prostatitis, decreased libido, edema, urination disorder, cold feeling of the lower abdomen, or uterine disease may be improved.

Massaging the "dae jang su" (bladder meridian) can normalize the function of the large intestine, recover energy, and cure the upset stomach. It can also harmonize the functions of digestive organs, lower back and knees. As a result, symptoms such as diarrhea, constipation, back pain, sciatica, abdominal pain, or urination disorder may be improved.

Massaging the "gwan won su" (bladder meridian) can normalize the lower body and urogenital function, keep the waist and knees healthy, and improve the congestion of moisture. As a result, symptoms such as decreased urogenital function, nocturnal enuresis, insomnia, nervous breakdown, back pain, constipation, or dysmenorrhea may be improved.

Massaging the "so jang su" (bladder meridian) can normalize the function of the small intestine, cure the upset stomach, and improve the excretory function. As a result, symptoms such as diarrhea, constipation, hemorrhoids, sciatica, knee joint pain, uterine disease, or urination disorder may be improved.

Massaging the "gyeok su" (bladder meridian) can relieve chest congestion, balance the energy of the stomach, clear the blood fever, and help recover from the weak health. As a result, symptoms such as acid indigestion, esophageal stricture, neurosis, palpitations, diaphragm spasm, bronchitis, chest pain, angina pectoris, or spinal pain may be improved.

Massaging the "gong choe" (lung meridian) can replenish the fluid in the lungs, stop bleeding, reduce fever, and dispel evil energy by sweating. As a result, symptoms such as chronic cough, sore throat, upper limb pain, or headache may be improved.

Massaging the "hap gok" (large intestine meridian) can cause sweating to reduce fever, remove wind-evil, release clear energy of lungs, and facilitate the flows so that the intestines and stomach function well. As a result, symptoms such as eye disease, elevation of blood pressure, headache, polyhidrosis, or cold may be improved.

Massaging the "su sam ni" (large intestine meridian) can remove wind-evil, facilitate the flow through meridians, and improve the function of the stomach and intestines. As a result, symptoms such as palsy-hemiplegia, diarrhea, blush, rhinitis, shoulder pain, indigestion, stomach pain, or lumbar pain may be improved.

Massaging the "gyeon jeong" (gallbladder meridian) can facilitate the flow along the meridian, normalize function, remove the putum, and refresh the mind. As a result, symptoms such as nausea, headache, vertigo, neck pain, or shoulder and back pain may be improved.

Massaging the "pung ji" (gallbladder meridian) can remove wind-evil, remove surface-evil by sweating, reduce fever, and allow smooth joints. As a result, symptoms such as headache, rhinitis, sinusitis, neck pain, back pain, back ache, hypertension, or insomnia may be improved.

(4) Description of Seo Geun Je Tong-neck Pain (relaxation scapularis Muscle) Mode Seo Geun Je Tong-neck pain (or relaxation scapularis muscle) mode is an acupressure and acupuncture massage mode centered around the shoulder and neck muscles, which is provided for the relaxation of the muscles of the spine and also for the improvement of the neck pain and shoulder pain. The acupuncture points "so jang gyeong" and "dam gyeong" distributed in the shoulder and neck muscles are mainly massaged, and the acupuncture points such as "sam cho gyeong" and "bang gwang gyeong" are supplementarily massaged.

To this end, in the Seo Geun Je Tong-neck pain mode, one or more of the acupuncture points "hyeon jong", "gol lyun", "eum neung cheon", "seung geun" and "seung san" (lower limb), "gyeon oe su", "gyeon jung su", "cheon ju", "pung ji" and "wan gol" (neck portion), and "hu gye", "jung jeo", "yeol gyeol", "oe gwan" and "so sang" (upper limb) are massaged.

Preferably, massage may be performed in the order of the lower limb, neck portion, upper limb, torso portion, neck portion, lower limb, neck portion, torso portion and neck portion.

The effects of each acupuncture point massage are as follows.

Massaging the " hyeon jong " (gallbladder meridian) can excrete the anger of the phlegm, clear the heat of the bone marrow, and expel wind-dampness (pain-inducing substance) of meridians. As a result, symptoms such as neck pain, lower limb paralysis, lower limb pain, diarrhea, or flank pain may be improved.

Massaging the "gol lyun" (bladder meridian) can remove the evil elements of the "tae yang gyeong", circulate stagnant blood in the uterus, relax muscles, remove the wind-evil and humidity-evil, and strengthen the waist and kidney. As a result, symptoms such as sciatica, ankle pain, shoulder and back pain, back pain, cystitis, abdominal pain, diarrhea, or headache may be improved.

Massaging the "eum neung cheon" (spleen meridian) can operate the "jung cho", release the moist congestion, regulate the function of the bladder, and remove the wind chill. As a result, symptoms such as lower limb edema, lower limb pain, abdominal cold, digestive disorder, back pain, anorexia, or abdominal inflation may be improved.

Massaging the "seung geun" (bladder meridian) can strengthen the waist and knees, and treat diseases of the anus. As a result, symptoms such as back pain, sciatica, lower limb pain, lower limb edema, or hemorrhoids may be improved.

Massaging the "seung san" (bladder meridian) can relax muscles, reduce blood fever, improve bowel function, treat hemorrhoids, and improve the function of the six entrails. As a result, symptoms such as back pain, indigestion, toe pain, disorder of menstruation, fever, constipation, or cold hand and feet syndrome may be improved.

Massaging the "gyeon oe su" (small Intestine meridian) can loosen the muscles, improve circulation in the choroid, remove wind-evil, and relieve pain. As a result, symptoms such as the shoulder pain, scapulalgia, headache, or neck cramps and pain may be improved.

Massaging the "gyeon jung su" (small Intestine meridian) can cause sweating and improve pulmonary function. As a result, symptoms such as bronchitis, neck pain, asthma, chronic cough, blush, scapulalgia, or backache may be improved.

Massaging the "cheon ju" (bladder meridian) can rejuvenate energy, and strength energy. As a result, symptoms such as hypertension, headache, stiff neck, fever, diarrhea, neurosis, sinusitis, palsy, shoulder and back pain, neck pain, amblyopia, optic atrophy optic atrophy, or sore throat may be improved.

Massaging the "pung ji" (gallbladder meridian) can remove wind-evil, remove surface-evil by sweating, reduce fever, and allow smooth joints. As a result, symptoms such as headache, rhinitis, sinusitis, neck pain, back pain, back ache, hypertension, or insomnia may be improved.

Massaging the "wan gol" (gallbladder meridian) can remove wind-evil, clear a fever, and stabilize the mind. As a result, symptoms such as facial paralysis, headache, stiff neck, insomnia, tinnitus, neck pain, or facial edema may be improved.

Massaging the "hu gye" (small Intestine meridian) can refresh the mind, remove internal fever, facilitate the flow through governor vessel, and strengthen the "pyo bun". As a result, symptoms such as severe headache, pneumonia, cold, fever, tinnitus, cooperate pain in the flank, back pain, or neck and shoulder pain may be improved.

Massaging the "jung jeo" (triple energizer meridian) can facilitate the flow of the lesser Yang energy, remove "sam cho" of the evil heat and improve the function of the face and the distribution organs. As a result, symptoms such as dizziness, headache, tinnitus, throat pain, scapulalgia, upper limb pain, upper extremity paralysis, or hypertension may be improved.

Massaging the "yeol gyeol" (lung meridian) can improve the pulmonary function, remove wind-evil, and facilitate the flow through meridians. As a result, symptoms such as headache, sore throat, neck pain, chronic cough, asthma, hives, or cold may be improved.

Massaging the "oe gwan" (triple energizer meridian) can remove the body surface of evil elements, release the blocked heat of "sam cho", and facilitate the flow of the stagnant energy of meridians. As a result, symptoms such as tinnitus, cold, headache, hip joint pain, somatalgia, headache, neck pain, abdominal pain, or constipation may be improved.

Massaging the "so sang" (lung meridian) can facilitate the flow of the energy of meridians, wake up from the fainting, clear the foul energy of the lungs, and remove the 12 meridians of anger force. As a result, symptoms such as throat pain, tonsillitis, calming of anxiety and excitement, digestive disorder, headaches, or neck pain may be improved.

(5) Description of Saeng-Hyeol-Bal-Gi (Vitality) Mode

The Saeng-Hyeol-Bal-Gi (or vitality) mode is a massage mode provided for fatigue recovery and vitality promotion. Massage stimulus may be applied to the major organ and bowel acupuncture point of the bladder meridian, mainly with respect to the kidney meridian as an example of inherent energy, and the spleen meridian and the stomach meridian corresponding thereto as an example of acquired energy, to obtain an effect of energizing the inherent and acquired energies to generate the vital energy and blood.

To this end, in the Saeng-Hyeol-Bal-Gi mode, one or more of the acupuncture points "yong cheon, "tae gye", "jok sam ni", "hyeol hae", "so bu", "gyeon jeong", "gan su", "bi su", "sim su", "sang nyo", "cha ryo" are massaged.

Preferably, massage may be performed in the order of the lower limb, line 1 of torso portion, neck portion, line 1 of torso portion, lower limb, line 2 of torso portion, neck portion upper limb, line 1 of torso portion, line 2 of torso portion, and lower limb.

The effects of each acupuncture point massage are as follows.

Massaging the "yong cheon" (kidney meridian) can clear the heat of the kidneys, lower the "eum hwa" (anger), refresh the mind, and restore consciousness. As a result, symptoms such as kidney disease, edema, cold feet, back pain, constipation, hypertension, shock, urination disorder, or infertility may be improved.

Massaging the "tae gye" (kidney meridian) can nourish the Yin of the body, eliminate consumptive fever, strengthen the Yang of the body, normalize the function of the uterus, and strengthen the waist and knees. As a result, symptoms such as heart pain, cold feet, sexual dysfunction, nervous breakdown, back pain, dysmenorrhea, or lower limb pain may be improved.

Massaging the "jok sam ni" (stomach meridian) can strengthen stomach, regulate the "jung gi" (digestive energy), soothe the upset stomach, and improve the bowel function. In addition, it may remove the wind-evil and humidity-evil, improve the circulation of vital energy and blood through the meridians, boost the spirit and vitality, and prevent disease. As a result, symptoms such as digestive diseases, neurosis, rhinitis, palsy-hemiplegia, hypertension, anemia, weak constitution, asthma, urination disorder, or edema may be improved.

Massaging the "hyeol hae" (spleen meridian) can regulate the blood, reduce the blood fever, and improve the flow at the lower belly. As a result, symptoms such as dysmenorrhea, amenorrhea, abdominal pain, knee arthritis, skin pruritus, anemia, or lower limb pain may be improved.

Massaging the "no gung" (heart meridian) can stabilize the mind, regulate the spirits, and clear away the fever in the body. As a result, symptoms such as chest pain, pectoralgia, mental instability, neurosis, palpitations, arrhythmia, heart disease, facial flushing, fever, or thermalgia may be improved.

Massaging the "gyeon jeong" (gallbladder meridian) can facilitate the flow along the meridian, normalize function, remove the putum, and refresh the mind. As a result, symptoms such as nausea, headache, vertigo, neck pain, or shoulder and back pain may be improved.

Massaging the "gan su" (bladder meridian) can strengthen spirits, release the stagnation of energy, and refresh the mind. As a result, symptoms such as hysteria, intercostal neuralgia, neurosis, back and spinal pain, insomnia, dizziness, eye pain, liver or gallbladder disease may be improved.

Massaging the "bi su" (bladder meridian) can help digestion, improve water metabolism, regulate energy, and balance spirits. As a result, symptoms such as gastritis, vomiting, stomach sickness and weakness, forgetfulness, flank pain, abdominal pain, edema, anemia, fatigue, or urticaria may be improved.

Massaging the "sim su" (bladder meridian) can enhance energization function, improve water metabolism, enhance procreation internal secretion function, and strengthen lumbar and belly. As a result, symptoms such as back pain, hypogonadism, infertility, decreased vision, edema, headache, nervous breakdown, or anemia may be improved.

Massaging the "sang nyo" (bladder meridian) can rejuvenate the functions of the "ha cho", normalize bladder and procreation internal secretion function, strengthen the back and knees, and treat the pain in the lumbar and sacrum. As a result, symptoms such as sciatica, back pain, infertility, or genital diseases may be improved.

Massaging the "cha ryo" (bladder meridian) can normalize bladder and procreation internal secretion function and treat back pain, sacrum pain and sciatica. As a result, symptoms such as sciatica, back pain, urethritis, urination disorder, dysmenorrhea, or hemorrhoids may be improved.

(6) Description of Geon-Wi-So-Sik (Geon-Wi) Mode

Geon-Wi-So-Sik mode (or Geon-Wi) is a massage mode that improves digestion and eliminates the indigestion. In order to improve the stomach function as an example of the acquired energy, the large intestine meridian and pericardium meridian are set as the meridians for the treatment mainly with respect to the spleen meridian and the stomach meridian corresponding thereto, and the massage stimulation is applied to the organ and bowel acupuncture points of the bladder meridian having the effect of improving digestive function, to thus obtain an effect that the stomach function is normalized and symptoms of the indigestion are relieved.

To this end, in the Geon-Wi-So-Sik mode, one or more of the acupuncture points "tae chung", "jok sam ni", "pung nyung" and "sam eum gyo" (lower limb portion), "hap gok", "nae gwan", "so bu" and "su sam ni" (upper limb portion), "dok su", "gyeok su", "gan su", "dam su", "bi su", "wi su", line 1 of "sam cho su", "gyeok gwan", "baek mun", "yang gang", "ui sa" and line 2 of "wi chang" (abdomen portion), and "gyeon jeong", "gyeon jung su", "gyeon oe su", "cheon jeong" and "pung ji" (neck portion) are massaged.

Preferably, massage may be performed in the order of lower limb ("tae chung", "jok sam ni", "pung nyung", "sam eum gyo"), upper limb ("hap gok", "nae gwan", "so bu", "su sam ni"), torso portion (line 1 of "bang wang gyeong" ("dok su", "gyeok su", "gan su", "dam su", "bi su", "wi su", "sam cho su"), line 2 of "bang gwang gyeong"("gyeok gwan", "hon mun", "yang gang", "ui sa", "wi chang"), neck portion ("gyeon jeong", "pung ji"), torso portion (line 1 of "bang gwang gyeong"("dok su", "gyeok su", "gan su", "dam su", "bi su", "wi su", "sam cho su"), line 2 of "bang gwang gyeong"("gyeok gwan", "hon mun", "yang gang", "ui sa", "wi chang")), upper limb ("hap gok", "nae gwan", "so bu", "su sam ni"), lower limb ("tae chung", "sam eum gyo", "chuk bin", "eum gok"), torso portion, neck portion ("gyeon jeong", "pung ji"), lower limb ("tae chung", "sam eum gyo", "chuk bin", "eum gok"), and upper limb ("hap gok", "nae gwan", "so bu", "su sam ni").

The effects of each acupuncture point massage are as follows.

Massaging the "tae chung" (liver meridian) can release the stagnation of the liver energy with the acupuncture points and energy sources of the liver meridian. As a result, symptoms such as indigestion, lower limb pain, or headache may be improved.

Massaging the "jok sam ni" (stomach meridian) can strengthen the stomach, regulate the "jung gi", reduce the upset stomach and improve the intestinal function, and also remove the wind-evil and humidity-evil, improve the circulation of the vital energy and blood through the meridians, boost spirit and vitality, and prevent disease. As a result, symptoms such as digestive diseases, neurosis, rhinitis, palsy-hemiplegia, hypertension, anemia, weak constitution, asthma, urination disorder, or edema may be improved.

Massaging the "pung nyung" (stomach meridian) can relax the vitality, remove the dampness and refresh the mind. As a result, symptoms such as lower limb pain, chest pain, abdominal pain, cough, sputum, headache, vertigo, limb edema, vomiting, or constipation may be improved.

Massaging the "sam eum gyo" (spleen meridian) can protect the spleen, help digestion, release the stagnation of the energy, loosen the tension of the "ha cho", normalize the functioning of the uterus and ovaries and testicles, and treat pain in the lower body. As a result, symptoms such as anorexia, indigestion, nervous breakdown, urogenital diseases, or cold hands and feet may be improved.

Massaging the "hap gok" (large intestine meridian) can cause sweating to reduce fever, remove wind-evil, release clear energy of lungs, and facilitate the flows so that the intestines and stomach function well. As a result, symptoms such as eye disease, elevation of blood pressure, headache, polyhidrosis, or cold may be improved.

Massaging the "nae gwan" (pericardium meridian) can clean the "po lak", facilitate the flow of energy of "sam cho", stabilize the mind, normalize the stomach function, relax the chest, and facilitate the flow of energy. As a result, symptoms such as hypertension, anxiety, palpitations, nausea, vomiting, gastritis, or chest pain may be improved.

Massaging the "so bu" (heart meridian) can stabilize the mind, regulate the spirits, and clear away the fever in the body. As a result, symptoms such as chest pain, pectoralgia, mental instability, neurosis, palpitations, arrhythmia, heart disease, facial flushing, fever, or thermalgia may be improved.

Massaging the "su sam ni" (large intestine meridian) can remove wind-evil, facilitate the flow through meridians, and improve the function of the stomach and intestines. As a result, symptoms such as palsy-hemiplegia, diarrhea, blush, rhinitis, shoulder pain, indigestion, stomach pain, or lumbar pain may be improved.

Massaging the "dok su" (bladder meridian) can facilitate the flow of energy of the chest and diaphragm parts, improve digestive function, and treat the pain of abdomen portion. As a result, symptoms such as pressure in the chest, stomachache, vowel sound, chest pain, abdominal pain, palpitations, or intercostal neuralgia may be improved.

Massaging the "gyeok su" (bladder meridian) can relieve chest congestion, balance the energy of the stomach, clear the blood fever, and help recover from the weak health. As a result, acid indigestion, esophageal stricture, neurosis, palpitations, diaphragm spasm, bronchitis, chest pain, angina pectoris, or spinal pain may be improved.

Massaging the "gan su" (bladder meridian) can strengthen spirits, release the stagnation of energy, and refresh the mind. As a result, symptoms such as hysteria, intercostal neuralgia, neurosis, back and spinal pain, insomnia, dizziness, eye pain, or liver and gallbladder disease may be improved.

Massaging the "dam su" (bladder meridian) can excrete the heat in the liver and gallbladder, improve digestion, and relax the thorax. As a result, symptoms such as liver and gallbladder disease, gastritis, shortness of breath, abdominal inflation, or sciatica may be improved.

Massaging the "bi su" (bladder meridian) can help digestion, improve water metabolism, regulate energy, and balance spirits. As a result, symptoms such as gastritis, vomiting, stomach sickness and weakness, forgetfulness, flank pain, abdominal pain, edema, anemia, fatigue, or urticaria may be improved.

Massaging the "wi su" (bladder meridian) can normalize digestive function and regulate stomach function. It may also protect the weak energy of the "jung cho". As a result, symptoms such as various digestive system diseases, insomnia, or fatigue may be improved.

Massaging the "sam cho su"(bladder meridian) can balance the energization, facilitate excretion of water, eliminate the chronic indigestion, and facilitate the function of "sam cho". As a result, symptoms such as erectile dysfunction, gastrointestinal cramps, indigestion, nocturnal enuresis, back pain, or edema may be improved.

Massaging the "gyeok gwan" (bladder meridian) can balance the energy of the diaphragm part and treat the pain of the abdomen portion and the lower chest. As a result, symptoms such as back ache, stomach pain, digestive disorder, dysphagia, or vomiting may be improved.

Massaging the "baek mun" (bladder meridian) can balance the function of the the lower chest portion and treat the digestive disorder. As a result, symptoms such as intercostal neuralgia, vomiting, diarrhea, or digestive disorder may be improved.

Massaging the "yang gang" (bladder meridian) can improve the function of the gallbladder and stomach, remove damp heat, and regulate the urine and feces. As a result, symptoms such as intercostal neuralgia, stomach cramps, vowel sound, abdominal pain, dysphagia , diarrhea, gastritis, or abdominal inflation may be improved.

Massaging the "ui sa" (bladder meridian) can improve the function of stomach, reduce a fever, and treat digestive disorder. As a result, symptoms such as gastrointestinal disease, stomach cramps, vomiting, diarrhea, fever, digestive disorder, or abdominal inflation may be improved.

Massaging the "wi chang" (bladder meridian) can improve digestive function by harmonizing the stomach function and regulating the energy. As a result, symptoms such as indigestion, gastritis, abdominal inflation, edema, or back ache may be improved.

Massaging the "gyeon jeong" (gallbladder meridian) can facilitate the flow along the meridian, normalize function, remove the putum, and refresh the mind. As a result, symptoms such as nausea, headache, vertigo, neck pain, or shoulder and back pain may be improved.

Massaging the "gyeon jung su" (small Intestine meridian) can cause sweating and improve pulmonary function. As a result, symptoms such as bronchitis, neck pain, asthma, chronic cough, blush, scapulalgia, or backache may be improved.

Massaging the "gyeon oe su" (small Intestine meridian) can loosen the muscles, improve circulation in the choroid, remove wind-evil, and relieve pain. As a result, symptoms such as the shoulder pain, scapulalgia, headache, or neck cramps and pain may be improved.

Massaging the "cheon jeong" (large intestine meridian) can soothe throat and clean lung energy. As a result, symptoms such as sore throat, dysphagia, neck pain, laryngitis, or sore throat may be improved.

Massaging the "pung ji" (gallbladder meridian) can remove wind-evil, remove surface-evil by sweating, reduce fever, and allow smooth joints. As a result, symptoms such as headache, rhinitis, sinusitis, neck pain, back pain, back ache, hypertension, or insomnia may be improved.

(7) Description of So-Jong-Mi-Gak (Mi-Gak) Mode

The So-Jong-Mi-Gak (or Mi-Gak) mode is a massage mode that relieves edema of the lower limb and improves the beauty of leg lines. The water metabolism and circulation of vital energy and blood in lower limb muscles and skin can be improved by first selecting nerves and the major acupuncture points "bi gyeong" and "gan gyeong" in the lower extremities, which are important for the water metabolism, and then, in consideration of the fact that water is delivered by the flow of the energy, selecting the relevant acupuncture points among the "bae su hyeol" of the "pye gyeong" and the "bang gwang gyeong".

For this purpose, in the Geon-Wi-So-Sik mode, one or more of the acupuncture points "tae yeon", "sin mun", "gong choe", "oe gwan" and "su sam ni" (upper limb), "gyeon jeong" and "pung ji" (neck portion), "bu bun", "baek ho", "go hwang", "sam cho su", "bang gwang su" and "gyeok su" (torso portion), and "jung do", "sam eum gyo", "su cheon", "bu lyu", and "eum neung cheon" (lower limb) are massaged.

Preferably, massage may be performed in the order of the upper limb ("tae yeon", "sin mun", "gong choe", "oe gwan", "su sam ni"), neck portion ("gyeon jeong", "pung ji", "pung bu"), torso portion ("bu bun", "baek ho", "go hwang", "sam cho su", "bang gwang su", "gyeok su"), lower limb ("jung do", "sam eum gyo", "su cheon", "bu lyu", "eum neung cheon"), torso portion ("bu bun", "baek ho", "go hwang", "sam cho su", "bang gwang su", "gyeok su"), lower limb ("jung do", "sam eum gyo", "su cheon", "bu lyu", "eum neung cheon"), upper limb ("tae yeon", "sin mun", "gong choe", "oe gwan", "su sam ni"), torso portion ("bu bun", "baek ho", "go hwang", "sam cho su", "bang gwang su", "gyeok su"), and lower limb ("jung do", "sam eum gyo", "su cheon", "bu lyu", "eum neung cheon").

The effects of each acupuncture point massage are as follows.

Massaging the "tae yeon" (lung meridian) can remove wind-evil, remove the sputum, improve the pulmonary function, stop the coughing, and clean the lung energy of the "sang cho". As a result, symptoms such as the chest pain, cough, asthma, hip joint pain, cold, or headache may be improved.

Massaging the "sin mun" (heart meridian) can stabilize the mind, calm anger force, cool down the spirits, clear away the anger fever, and regulate the upward rush of energy. As a result, symptoms such as heart disease, neurosis, psychosis, palpitations, insomnia, and asthma may be improved.

Massaging the "gong choe" (lung meridian) can replenish the fluid in the lungs, stop bleeding, reduce fever, and dispel evil energy by sweating. As a result, symptoms such as chronic cough, sore throat, upper limb pain, or headache may be improved.

Massaging the "oe gwan" (triple energizer meridian) can remove the body surface of evil elements, release the blocked heat of "sam cho", and facilitate the flow of the stagnant energy of meridians. As a result, symptoms such as tinnitus, cold, headache, hip joint pain, somatalgia, headache, neck pain, abdominal pain, or constipation may be improved.

Massaging the "su sam ni" (large intestine meridian) can remove wind-evil, facilitate the flow through meridians, and improve the function of the stomach and intestines. As a result, symptoms such as palsy-hemiplegia, diarrhea, blush, rhinitis, shoulder pain, indigestion, stomach pain, or lumbar pain may be improved.

Massaging the "gyeon jeong" (gallbladder meridian) can facilitate the flow along the meridian, normalize function, remove the putum, and refresh the mind. As a result, symptoms such as nausea, headache, vertigo, neck pain, or shoulder and back pain may be improved.

Massaging the "pung ji" (gallbladder meridian) can remove wind-evil, remove surface-evil by sweating, reduce fever, and allow smooth joints. As a result, symptoms such as headache, rhinitis, sinusitis, neck pain, back pain, back ache, hypertension, or insomnia may be improved.

Massaging the "bu bun" (bladder meridian) can facilitate the flow of the lung energy and relieve pain. As a result, symptoms such as neck pain, upper limb pain, or intercostal neuralgia may be improved.

Massaging the "baek ho" (bladder meridian) can allow the energy of lungs to be stretched out and through, calm asthma, or stop coughing. As a result, symptoms such as chronic cough, asthma, shoulder and back pain, or neck stiffness may be improved.

Massaging the "go hwang" (bladder meridian) can strengthen the lungs, make the spleen healthy, reinforce weak health, relax the heart, or strengthen the kidneys. As a result, symptoms such as respiratory disease, heart disease, neurosis, acid indigestion, forgetfulness, or shoulder and back pain may be improved.

Massaging the "sam cho su"(bladder meridian) can balance the energization, facilitate excretion of water, eliminate the chronic indigestion, and facilitate the function of "sam cho". As a result, symptoms such as erectile dysfunction, gastrointestinal cramps, indigestion, nocturnal enuresis, back pain, or edema may be improved.

Massaging the "bang gwang su" (bladder meridian) can regulate the bladder, stretch out the energy of the "ha cho", smooth the back and spine, and remove wind-dampness. As a result, symptoms such as sciatica, back pain, spinal pain, lower limb lethargy, constipation, or urogenital diseases may be improved.

Massaging the "gyeok su" (bladder meridian) can relieve chest congestion, balance the energy of the stomach, clear the blood fever, and help recover from the weak health. As a result, acid indigestion, esophageal stricture, neurosis, palpitations, diaphragm spasm, bronchitis, chest pain, angina pectoris, or spinal pain may be improved.

Massaging the "jung do" (liver meridian) can improve digestive function and reproductive function. As a result, symptoms such as enterodynia, abdominal pain, uterine bleeding, lower limb pain, or ankle pain may be improved.

Massaging the "sam eum gyo" (spleen meridian) can protect the spleen, help digestion, release the stagnation of the energy, loosen the tension of the "ha cho", normalize the functioning of the uterus and ovaries and testicles, and treat pain in the lower body. As a result, symptoms such as anorexia, indigestion, nervous breakdown, urogenital diseases, or cold hands and feet may be improved.

Massaging the "su cheon" (kidney meridian) can facilitate the flow through the meridians, harmonize spirits, dispel anger force, facilitate the flow of vital energy, refresh the mind, and soothe the throat. As a result, symptoms such as urination disorder, dysmenorrhea, abdominal pain or lower limb pain may be improved.

Massaging the "bu lyu" (kidney meridian) can normalize the excretion of sweat, help the urinary excretion of the bladder, remove the humidity-evil, relieve indigestion, and replenish the "sin jeong". As a result, symptoms such as limb edema, edema, lower limb pain, abdominal inflation, hemorrhoids, diarrhea, or sweating control may be improved.

Massaging the "eum neung cheon" (spleen meridian) can operate the "jung cho", release the moist congestion, regulate the function of the bladder, and remove the wind chill. As a result, symptoms such as lower limb edema, lower limb pain, abdominal cold, digestive disorder, back pain, anorexia, or abdominal inflation may be improved.

Although it has been described above with reference to preferred embodiments of the present invention, it will be appreciated that those skilled in the art will be able to variously modify and change the present invention without departing from the spirit and scope of the disclosure described in the claims below.

10: massage chair
100: back support portion
102: back airbag
110: headrest
120: shoulder massage portion
122: shoulder airbag
200: seat
204: thigh airbag

300: support frame
310: arm massage portion
312: arm airbag
312*a*: first arm airbag
312*b*: second arm airbag
312*c*: third arm airbag
400: calf massage portion
402: outer calf airbag
402*a*: first outer calf airbag
402*b*: second outer calf airbag
404: inner calf airbag
404*a*: first inner calf airbag
404*b*: second inner calf airbag
406: rear calf airbag
406*a*: first rear calf airbag
406*b*: second rear calf airbag
408: calf massage ball
410: protrusion
500: foot massage portion
502: foot airbag
502*a*: front foot airbag
502*b*: instep airbag
504: sole airbag
506: sole massage ball
600: manipulation portion
610: shoulder height measurement module
620: hip bone location prediction module
630: massage location determination module
632: massage portion drive module
640: massage mode selection module
642: massage performance module
650: user information input module
660: BMI calculation module
670: massage intensity setting module
680: hip bone location correction module
700: massage ball assembly
710: first bracket
720: upper massage ball
730: lower massage ball
740: massage bundle
742: actuator
750: second bracket
760: support
770: heating element
780: driver

What is claimed is:

1. A massage chair comprising:

a seat;

a back support portion rotatably mounted on one side of the seat;

a calf massage portion rotatably mounted on the other side of the seat; and a manipulation portion capable of adjusting movements of the back support portion and the calf massage portion, wherein the manipulation portion includes:

a shoulder height measurement module for measuring a shoulder height of the user;

a hip bone position prediction module for predicting a hip bone position by using a preset first method with reference to the shoulder height measured by the shoulder height measurement module;

a massage position determination module for determining a plurality of massage positions based on the hip bone position predicted by the hip bone position prediction module; and a massage mode selection module for selecting one massage mode of a plurality of pre-stored massage modes based on the plurality of massage positions determined by the massage position determination module, thereby massaging the plurality of massage positions determined by the massage position determination module in accordance with the massage mode selected by the massage mode selection module, and when the measured shoulder height is less than a predetermined first shoulder height value, at the hip bone location prediction module, predicting a location of the hip bone to be a predetermined first hip bone location value;

when the measured shoulder height is equal to or greater than the predetermined first shoulder height value and less than a predetermined second shoulder height value, predicting, at the hip bone location prediction module the location of the hip bone to be a predetermined second hip bone location value; and when the measured shoulder height is equal to or greater than the predetermined second shoulder height value, predicting, at the hip bone location prediction module, the location of the hip bone to be a predetermined third hip bone location value, wherein the second shoulder height value is greater than the first shoulder height value, and the second hip bone location value is greater than the first hip bone location value and less than the third hip bone location value.

2. The massage chair according to claim 1, wherein the manipulation portion further comprises:

a massage portion drive module for moving one or more of the back support portion, the calf massage portion, and a foot massage portion to a plurality of massage locations determined by the massage location determination module; and a massage performance module for controlling one or more of airbags, massage balls and a massage ball assembly in accordance with the massage mode determined by the massage mode selection module.

3. The massage chair according to claim 2, wherein the manipulation portion further comprises:

a user information input module for receiving one or more of gender information and age information of a user, and height information and weight information of the user;

a BMI calculation module for calculating a body mass index (BMI) using the height information and the weight information input to the user information input module; and a massage intensity setting module for setting intensity of massage with a preset second method using the BMI calculated by the BMI calculation module, thereby massaging the plurality of massage positions determined by the massage position determination module in accordance with the massage intensity set by the massage intensity setting module.

4. The massage chair according to claim 3, wherein the preset second method comprises:

when the calculated BMI is less than a predetermined first BMI value, at the massage intensity setting module, setting the intensity of massage to a predetermined first value;

when the calculated BMI is equal to or greater than the predetermined first BMI value and less than a predetermined second BMI value, setting, at the massage intensity setting module, the intensity of massage to a predetermined second value; and when the calculated BMI is equal to or greater than the predetermined second BMI value, setting, at the massage intensity setting module, the intensity of massage to a predetermined third value, wherein the second BMI value is greater than the first BMI value, and the second value is greater than the first value and less than the third value.

5. The massage chair according to claim 4, wherein the manipulation portion further comprises a hip bone location correction module for correcting the hip bone location predicted by the hip bone location prediction module using the height information input to the user information input module, the massage location determination module determines a plurality of massage locations based on the hip bone location corrected by the hip bone location correction module, and the massage mode selection module determines a massage mode based on the plurality of massage locations determined by the massage location determination module.

6. The massage chair according to claim 5, wherein the massage portion drive module moves one or more of the back support portion, the calf massage portion, and the foot massage portion in accordance with the plurality of massage locations determined by the massage location determination module, and the massage performance module controls one or more of the airbags, the massage balls, and the massage ball assembly in accordance with the massage mode determined by the massage mode selection module.

7. The massage chair according to claim 1, wherein the plurality of massage modes include a Hae-Ul-Cheong-Sim mode, wherein, among the plurality of massage locations determined, the Hae-Ul-Cheong-Sim mode massages one or more of acupuncture points "tae chung", "sam eum gyo", "chuk bin", "eum gok", "gyeok su", "gan su", "sim su", "pye su", "baek ho", "go hwang", "sin dang", "gyeon jeong", "pung ji", "no gung", "so bu", "sin mun", "nae gwan", and "su sam ni".

8. The massage chair according to claim 1, wherein the plurality of massage modes include an Ahn-Shin-Do-Myeon mode, wherein, among the plurality of massage locations determined, the Ahn-Shin-Do-Myeon mode massages one or more of acupuncture points "an myeon hyeol", "pung ji", "nae gwan", "so bu", "gyeon jeong", "sim su", "bi su", "eum neung cheon", "sam eum gyo", "nae chung", and "sil myeon".

9. The massage chair according to claim 1, wherein the plurality of massage modes include a Seo Geun Je Tong-back pain mode, wherein, among the plurality of massage locations determined, the Seo Geun Je Tong-back pain mode massages one or more of acupuncture points "eum neung cheon", "seung geun", "seung san", "dae do", "sim su", "ji sil", "dae jang su", "gwan won su", "so jang su", "gyeok su", "gong choe", "hap gok", "su sam ni", "gyeon jeong", and "pung ji".

10. The massage chair according to claim 1, wherein the plurality of massage modes include a Seo Geun Je Tong-neck pain mode, wherein, among the plurality of massage locations determined, the Seo Geun Je Tong-neck pain mode massages one or more of acupuncture points "hyeon jong", "gol lyun", "eum neung cheon", "seung geun", "seung san", "gyeon oe su", "gyeon jung su", "cheon ju", "pung ji", "wan gol", "hu gye", "jung jeo", "yeol gyeol", "oe gwan", and "so sang".

11. The massage chair according to claim 1, wherein the plurality of massage modes include a Saeng-Hyeol-Bal-Gi mode, wherein, among the plurality of massage locations determined, the Saeng-Hyeol-Bal-Gi mode massages one or more of acupuncture points "yong cheon, "tae gye", "jok sam ni", "hyeol hae", "so bu", "gyeon jeong", "gan su", "bi su", "sim su", "sang nyo", and "cha ryo".

12. The massage chair according to claim 1, wherein the plurality of massage modes include a Geon-Wi-So-Sik mode, wherein, among the plurality of massage locations determined, the Geon-Wi-So-Sik mode massages one or more of acupuncture points "tae chung", "jok sam ni", "pung nyung", "sam eum gyo", "hap gok", "nae gwan", "so bu", "su sam ni", "dok su", "gyeok su", "gan su", "dam su", "bi su", "wi su", "sam cho su", "gyeok gwan", baek mun, "yang gang", "ui sa", "wi chang", "gyeon jeong", "gyeon jung su", "gyeon oe su", "cheon jeong" and "pung ji".

13. The massage chair according to claim 1, wherein the plurality of massage modes include a So-Jong-Mi-Gak mode, wherein, among the plurality of massage locations determined, the So-Jong-Mi-Gak mode massages one or more of acupuncture points "tae yeon", "sin mun", "gong choe", "oe gwan", "su sam ni", "gyeon jeong", "pung ji", "bu bun", "baek ho", "go hwang", "sam cho su", "bang gwang su", "gyeok su", "jung do", "sam eum gyo", "su cheon", "bu lyu" and "eum neung cheon".

* * * * *